US011865433B2

(12) United States Patent
Loichinger et al.

(10) Patent No.: US 11,865,433 B2
(45) Date of Patent: Jan. 9, 2024

(54) SKIBINDING, IN PARTICULAR TOURING SKIBINDING

(71) Applicant: Fritschi AG—Swiss Bindings, Reichenbach im Kandertal (CH)

(72) Inventors: Albert Loichinger, Langnau am Albis (CH); Micha Baggenstos, Uster (CH); Stefan Ibach, Kirchdorf (CH); François Christinat, Huenibach (CH); Theo Eggimann, Muehlethurnen (CH)

(73) Assignee: FRITSCHIAG—SWISS BINDINGS, Reichenbach Im Kandertal (CH)

( * ) Notice: Subject to any disclaimer, the term of this patent is extended or adjusted under 35 U.S.C. 154(b) by 0 days.

(21) Appl. No.: 18/091,648

(22) Filed: Dec. 30, 2022

(65) Prior Publication Data

US 2023/0149794 A1 May 18, 2023

Related U.S. Application Data

(63) Continuation-in-part of application No. 17/976,087, filed on Oct. 28, 2022.

(30) Foreign Application Priority Data

Oct. 28, 2021 (EP) ..... 21205148
Oct. 27, 2022 (EP) ..... 22204228

(51) Int. Cl.
*A63C 9/086* (2012.01)
*A63C 7/10* (2006.01)

(52) U.S. Cl.
CPC ..... *A63C 9/086* (2013.01); *A63C 7/1013* (2013.01)

(58) Field of Classification Search
CPC ... A63C 9/18; A63C 9/08514; A63C 9/08521; A63C 9/08585; A63C 9/086
See application file for complete search history.

(56) References Cited

U.S. PATENT DOCUMENTS

2003/0101622 A1* 6/2003 Darnell ..... A43C 15/06 36/122
2003/0168830 A1* 9/2003 Haughlin ..... A63C 9/20 280/615

(Continued)

FOREIGN PATENT DOCUMENTS

CH 659397 A5 * 1/1987
DE 20208913 U1 * 11/2002 ..... A63C 9/00

(Continued)

OTHER PUBLICATIONS

Search Report issued in European priority application 21205148.6, dated May 4, 2022.

(Continued)

*Primary Examiner* — James A Shriver, II
*Assistant Examiner* — Michael T. Walsh
(74) *Attorney, Agent, or Firm* — BIRCH, STEWART, KOLASCH & BIRCH, LLP

(57) ABSTRACT

A touring skibinding (1) comprises a support element (2) which can be fastened to the ski, a bearing element (3) with a skiboot reception (4) which is designed in such a way that the skiboot (5) can be mounted in the skiboot reception (4) such that the skiboot can pivot about a first pivot axis (S1) with respect to the skiboot reception (4) and a convex supporting surface (6) on which the skiboot (5) can roll, the bearing element (3) being connected to the support element (2) so as to be pivotable about a second pivot axis (S2) from an initial state into a pivoted state, wherein the skiboot (5) is moveable from a standing state, in which the skiboot (5) stands on the convex supporting surface (6), into a pulling state, in which the skiboot (5) is at least partially lifted from the convex supporting surface (6), wherein, starting from the standing state, the skiboot (5) is movable on the convex supporting surface (6) in the direction of the pulling state in such a manner that the skiboot (5) rolls on the convex (Continued)

support surface (6), wherein a pivoting movement of the skiboot (5) about the first pivot axis (S1) and of the bearing element (3) about the second pivot axis (S2) is effected simultaneously with the rolling process.

18 Claims, 11 Drawing Sheets

(56) References Cited

U.S. PATENT DOCUMENTS

| | | | | |
|---|---|---|---|---|
| 2013/0009387 | A1 | 1/2013 | Maruelli | |
| 2013/0300089 | A1 | 11/2013 | Barthel | |
| 2020/0139220 | A1 * | 5/2020 | Surdy | A63C 9/02 |

FOREIGN PATENT DOCUMENTS

| | | | | |
|---|---|---|---|---|
| EP | 0324933 | A2 * | 7/1989 | |
| EP | 0890379 | A1 * | 1/1999 | |
| EP | 2662121 | A2 | 11/2013 | |
| IT | UB20156856 | A1 | 6/2017 | |
| RU | 2288017 | C2 * | 11/2006 | A43B 5/0413 |
| WO | WO 01/93963 | A1 | 12/2001 | |
| WO | WO-0193963 | A1 * | 12/2001 | A63C 9/20 |

OTHER PUBLICATIONS

Search Report issued in European priority application 22204228.5, dated Dec. 9, 2022.

* cited by examiner

SKIBINDING, IN PARTICULAR TOURING SKIBINDING

CROSS REFERENCE TO RELATED APPLICATIONS

This application is a Continuation-in-Part of copending application Ser. No. 17/976,087, filed on Oct. 28, 2022, which claims priority under 35 U.S.C. § 119(a) to Application No. 21 205 148.6, filed in Europe on Oct. 28, 2021 and claims priority to Application No. 22 204 228.5, filed in Europe on Oct. 27, 2022, all of which are hereby expressly incorporated by reference into the present application.

TECHNICAL FIELD

The present invention relates to a skibinding, in particular a touring skibinding, comprising a support element which can be fastened to the ski and a bearing element having a skiboot reception, which skiboot reception is designed in such a way that the skiboot can be mounted in the skiboot reception such that it can pivot about a first pivot axis with respect to the skiboot reception, and also to an arrangement comprising a ski binding according to the invention and a ski boot, the tip of the ski boot having a bearing site for pivotabl connection to the skiboot reception.

STATE OF THE ART

Touring skibindings are known from the state of the art. For an ascent, the touring skibinding can be adjusted in such a way that the skiboot is only connected to the touring skibinding at the toe of the boot. The heel can be moved freely with respect to the surface of the ski. For a descent, the heel is on the other hand fixed.

A touring skibinding has become known from DE 202 08 913 U1, which is intended to enable natural rolling during ascent. For this purpose, the touring skibinding has a stand plate. The stand plate is connected at the front to a first hinge. The hinge is connected to a plate, which in turn is connected to a support element by another hinge. The support element is located below the stand plate. Due to this design, the movement sequence of walking is interrupted when the pivoting movement around the further hinge has taken place and the plate stands up on the ski and then the pivoting movement around the first hinge begins.

Furthermore, there is the disadvantage that the technical implementation leads to a mechanism that reproduces an inaccurate, slackly behavior and is also very error-prone.

For the description of skibindings, a (fictitious) ski is often used as a reference system, assuming that the binding is mounted on this ski. This habit is adopted in the present text. In this reference system, the term "longitudinal direction of the ski" means along the orientation of the longitudinal axis of the ski. Similarly, for an elongated object, "skiparallel" means aligned along the longitudinal axis of the ski. In contrast, for a planar object, the term "skiparallel" means aligned parallel to the gliding surface of the ski. Further, the term "transverse direction of the ski" means a direction transverse to the longitudinal direction of the ski, which however does not need to be oriented exactly perpendicular to the longitudinal axis of the ski. Its orientation can also deviate somewhat from a right angle. The term "ski center", in turn, means a center of the ski horizontally viewed in the transverse direction of the ski, while the term "ski fixed" means not movable relative to the ski. In addition, it should be noted that terms which do not contain the word "ski" also refer to the reference system of the (fictitious) ski. Thus, the terms "front", "back", "top", "bottom" as well as "side" refer to "front", "back", "top", "bottom" as well as "side" of the ski. Likewise, terms such as "horizontal" and "vertical" also refer to the ski, where "horizontal" means lying in a plane parallel to the ski and "vertical" means oriented perpendicular to this plane.

PRESENTATION OF THE INVENTION

Based on this prior art, the task of the invention is providing a skibinding, in particular a touring skibinding, which enables an improved motion sequence during the ascent. The object of claim 1 solves this problem. Accordingly, a skibinding, in particular a touring skibinding, comprises a support element which can be fastened to the ski, a bearing element with a skiboot reception which is designed in such a way that the skiboot can be mounted or is mounted in the skiboot reception such that it can pivot about a first pivot axis with respect to the skiboot reception, and a convex supporting surface on which the skiboot can roll. The bearing element is connected to the support element pivotably about a second pivot axis from an initial state to a pivoted state. The skiboot is movable from a standing state, in which the skiboot stands on the convex supporting surface, into a pulling state, in which the skiboot is at least partially lifted from the convex supporting surface. Starting from the standing state, the skiboot can be moved on the convex supporting surface in the direction of the pulling state in such a way that the skiboot rolls on the convex supporting surface. A pivoting movement of the skiboot about the first pivot axis and of the bearing element about the second pivot axis is effected simultaneously with the rolling process.

The arrangement of the two pivot axes and the convex supporting surface has the advantage that the skiboot can be guided in a very ergonomic motion sequence. This motion sequence preferably further approximates, even with a rigid skiboot, the natural barefoot walking that humans prefer. In particular, a dynamic and fluid movement, especially also of the skier's entire body, can be achieved, which can be executed without interruption of movement. This sequence corresponds more to normal walking with a fluid movement of the upper body. In prior art binding concepts, the foot usually has to be put down each time when climbing a hill or walking on level ground before the weight can be shifted and the next step can be taken. This leads to a rather jerky or stop-and-go movement of the skier. Rolling according to the invention allows the hips and upper body to move with far less deceleration and acceleration, and thus to move more fluidly and thus with less effort. Thus, besides the muscular loads, the loads on the skier's joints and ligaments are also noticeably reduced.

As mentioned, the skier moves the skiboot from the standing state to the pulling state. The standing state is the state in which the skier stands firmly on the ski. If a climbing aid is optionally used, an additional distance between the heel and the ski can be created in the standing state, with the front part of the skiboot still resting on the supporting surface. The roll process is then shortened compared to the roll process without a climbing aid, whereby the movements of the pivot axes take place analogously. The pulling state is the state in which the skier pulls the ski forward in order to initiate the next step with the ski. In the pulling state, the ski is pulled while hanging on the boot. In the pulling state, the skiboot is lifted at the heel at least partially from the convex supporting surface. At least partially lifted means that the skiboot is partially or completely lifted from the convex supporting surface.

A convex supporting surface is a supporting surface which is designed in such a way that a roll process can be provided. Preferably, the convex supporting surface is convexly curved with a radius of curvature about an axis of curvature. The axis of curvature runs parallel to the said pivot axes. The convex supporting surface can have the same radius of curvature everywhere or different radii of curvature depending on the position on the convex supporting surface. In addition, the position of the axis of curvature can also change depending on the position on the supporting surface. Regardless of this, the convex supporting surface is preferably convexly curved.

Preferably, the movement of the skiboot from the standing state and the initial state of the bearing element into the pulling state is guided exclusively via the convex supporting surface and the first pivot axis and the second pivot axis. If the skiboot is completely lifted from the convex supporting surface, the movement is guided exclusively via the first pivot axis and the second pivot axis.

When the skiboot moves in the direction of the pulling state, the skiboot, as mentioned, performs a pivoting movement about the first pivot axis and the bearing element performs a pivoting movement about the second pivot axis. In the process, the skiboot reception is pivoted with the first pivot axis downward with respect to the second pivot axis toward the support element or the ski. The movement in the direction of the pulling state is thus such that the tip of the skiboot is moved downward toward the ski.

Preferably, the pivot movement about the first pivot axis is in a different pivot direction than the pivot movement about the second pivot axis.

Preferably, the second pivot axis is located on the support element in such a way that its distance from the ski on which the support element is mounted is fixed.

When the skiboot moves into the pulling state, the bearing element, after the ski boot has reached an intermediate state, is fixedly abutted on the support element in its pivoted state in a first phase of the movement between the intermediate state and the pulling state and is pivoted back to its initial state in a second phase of said movement. In other words, the bearing element is fixedly abutted on the support element in the intermediate state, in particular in its pivoted state, and is then pivoted away from the support element again during the further movement of the skiboot into the pulling state. In the intermediate state, the bearing element is thus in its pivoted state.

Preferably, the first pivot axis runs parallel to the second pivot axis and the first pivot axis can be pivoted about the second pivot axis. Thereby, the position of the second pivot axis is fixed with respect to the support element or the ski. Preferably, the maximum pivot angle of the first pivot axis about the second pivot axis is in the range of 10° to 35°, in particular in the range of 20° to 30°. In other words, the first pivot axis can be pivoted around the second pivot axis by this maximum pivot angle. Preferably, the first pivot axis lowers in the direction of the ski during the movement sequence of a step. Advantageously, during a pivoting movement of the bearing element about the second pivot axis, the first pivot axis can be lowered by at least 10 mm, particularly advantageously by at least 15 mm, towards the ski. Preferably, the first pivot axis can be moved away from the ski by at least 10 mm, particularly advantageously by at least 15 mm, starting from the pivoted state of the bearing element by a pivoting movement of the bearing element about the second pivoted axis.

Preferably, the maximum pivot angle of the skiboot about the first pivot axis is larger than the maximum pivot angle of the first pivot axis about the second pivot axis. In a variant to this, however, it is also possible that the maximum pivot angle of the skiboot about the first pivot axis is the same as the maximum pivot angle of the first pivot axis about the second pivot axis or is smaller than the maximum pivot angle of the first pivot axis about the second pivot axis.

The first and/or second pivot axis may be provided by a physical axle in the form of a cylinder. Alternatively, the first and/or the second pivot axis can also be generated by a bendable or flexible element such as a spring plate, a rubber part or a webbing. In this case, the movability can also result approximately like a fixed axle of rotation.

Preferably, the two pivot axes remain parallel to each other during the entire movement from the standing state to the initial state.

Preferably, the first pivot axis and the second pivot axis span a reference plane in the standing state. The first pivot axis is moved away from this reference plane and moved back towards this reference plane before reaching the pulling state. In other words, when moving from the standing state to the pulling state, the first pivot axis is deflected out of the reference plane and then moved back in the direction of the reference plane. It is irrelevant whether the first pivot axis is below the reference plane, in the reference plane or above the reference plane when the pulling state is reached.

The reference plane is substantially parallel to a mounting surface of the support element with which the support element is mountable on the surface of a ski. In the mounted state, the reference plane is preferably substantially parallel to the surface of the ski on which the skibinding is mounted on the ski. When a climbing aid is used, the reference plane runs at an angle to the mounting surface or the surface of the ski, respectively.

Preferably, the first pivot axis provides an articulated joint between the skiboot and the skiboot reception.

Preferably, when climbing, in the standing state position a climbing aid can support the heel elevated relative to the ski.

Preferably, the first pivot axis is located between the second pivot axis and the skiboot.

Preferably, both pivot axes move simultaneously in such a way that the point of contact between the skiboot and the supporting surface is without sliding movement and thus without friction wear. In other words, the skiboot rolls on the supporting surface in the sense of a rolling movement without any sliding movement between the skiboot and the supporting surface.

Preferably, the skibinding further comprises a locking element with which the bearing element can be locked to the support element, in particular can be locked in a downhill state to the support element, so that pivoting between the bearing element and the support element is made impossible. Accordingly, the skiboot cannot be moved into the pulling state. The locking device allows the skibinding to be fixed for downhill runs so that the tip and heel of the skiboot are rigidly fixed. In this case, the downhill state of the bearing element can correspond to the initial state described above or deviate from the initial state described above. In an advantageous variant, the bearing element is connected to the support element so as to be pivotable about the second pivot axis from the downhill state to the pivoted state, the bearing element being moved first to the initial state and from the initial state further to the pivoted state during a continuous pivoting movement from the downhill state to the pivoted state. That is, the initial state is preferably located between the downhill state and the pivoted state. This has the advantage that the first pivot axis is further away from the ski in the downhill state than in the initial state. As a result, the ski binding can be fixed by means of the locking device for downhill runs in such a way that the tip and the heel of the skiboot are rigidly fixed and the skiboot is held above the convex supporting surface in the skibinding. This has the advantage that the skibinding can be used for different skiboots without further adjustments. The reason for this is that, depending on the shape of the skiboot, in the standing state in which the skiboot rests on the convex supporting surface, the distance between the first pivot axis and the ski can vary. Thus, in the initial state, the first pivot axis can be at a different height above the ski depending on the shape of the skiboot. By providing a downhill state in which the first pivot axis is further away from the ski than in the initial state, it is ensured that the skibinding allows a standing state of the skiboot for all common skiboots in which the skiboot stands up on the convex supporting surface, and at the same time, with the downhill state for all common skiboots, a rigid fixation of the tip and heel of the skiboot is made possible in a simple manner. In this variant, starting from the pivoted state of the bearing element, the first pivot axis can advantageously be moved away from the ski to the downhill state by a pivoting movement of the bearing element about the second pivot axis by at least 10 mm, particularly advantageously by at least 15 mm.

Preferably, the locking element is provided by an opening in the support element, an opening in the bearing element, and a locking pin insertable into the openings, wherein when the locking pin is inserted, the bearing element is locked to the support element. In a preferred embodiment, however, the locking element is a slidable element in the bearing element, wherein the locking element can be slid to a position in which it is supported on the support element, thereby locking the bearing element to the support element. The ski tourer can lock the skibinding with a very simple element for the descent. Alternatively, this can also be done by a frictionally engaged or form-fitted element such as a clamping device or a blocking element.

Preferably, the support element has a base plate from which two spaced bearing blocks project. The bearing blocks have the bearing sites for the pivotable mounting of the bearing element relative to the support element. The bearing element extends between the two bearing blocks. The base plate can, for example, be formed by a metal plate whose upwardly bent ends form the two bearing blocks. However, the support element may also have other elements, such as an insert element.

Preferably, the base plate has a mounting surface on its underside with which the support element can be mounted on the surface of a ski.

Preferably, the base plate has a plurality of mounting holes. The mounting holes are used to accommodate mounting screws with which the support element can be fixedly connected to a ski.

Preferably, the bearing blocks extend away from a top surface of the base plate and are located on two opposite side edges of the base plate.

Preferably, each of the bearing blocks has a bearing opening. A bearing bolt extends through the bearing openings. The bearing element is mounted on said bearing bolt. The bearing bolt defines the second pivot axis.

Preferably, the bearing bolt is firmly connected to the bearing element. The bearing bolt and the bearing openings form a plain bearing, whereby the bearing bolt can be pivoted accordingly in the plain bearing. Alternatively, the bearing bolt is fixedly mounted in the opening and the bearing element is designed to pivot relative to the bearing bolt.

Preferably, the skiboot reception is outside the space between the two bearing blocks in any state.

Preferably, the support element has a first support element side stop surface and a second support element side stop surface. The bearing element has a first bearing element side stop surface and a second support element side stop surface, wherein in the initial state the first bearing element side stop surface abuts the first support element side stop surface and wherein in the pivoted state the second bearing element side stop surface abuts the second support element side stop surface. In a variant, however, it is also possible for the first bearing element side stop surface not to be in contact with the first support element side stop surface in the initial state, while in the pivoted state the second bearing element side stop surface is abuts the second support element side stop surface. In a preferred variant, the first bearing element side stop surface abuts the first support element side stop surface in the downhill state described above, while in the pivoted state, the second bearing element side stop surface abuts the second support element side stop surface.

In one variant, the convex supporting surface is provided by a convex upper side of a bottom plate. In another variant, the convex supporting surface is provided by a convex underside of the skiboot. In another variant, the convex supporting surface is provided by a convex upper side of the bottom plate and by a convex underside of the skiboot. The convexity can also be provided approximated, for example, by a step contour. In another variation, the sole of the skiboot and the surface of the bottom plate may each have a contour, with the two contours interlocking. In this variation, the contour can provide the convexity. The contour can further increase lateral stability for the skiboot.

Preferably, the bottom plate is mounted on the surface of the ski. Preferably, the bottom plate is matched in contour and height to other elements of the skibinding. The contour and height of the bottom plate can also be designed to match the convexity of the skiboot. The bottom plate can also be designed to be fixed or integrated to the ski. The bottom plate can also be flat if the underside of the skiboot is convex.

The bottom plate is preferably formed separately from the support element. However, the bottom plate can also be an integral part of the support element.

Regardless of whether the bottom plate is formed separately from the support element or whether the bottom plate is an integral part of the support element, the bottom plate preferably has a crampon holding device for attaching a crampon to the bottom plate and for holding the crampon. Preferably, the bottom plate thereby comprises a base element attachable to the ski and a cover element attachable to the base element, the cover element being movable into a cover state in which a supporting surface of the cover element is aligned such that the skiboot held in the skibinding can be supported downwardly on the supporting surface wherein the cover element is movable away from the cover state, in particular into a uncovered state, wherein, when the cover element is moved away from its cover state, in particular into the uncovered state, the crampon is attachable to the crampon holding device to be held by the crampon holding device. Advantageously, the crampon is attachable to the crampon holding device in such a way that a surface of the crampon is positioned at substantially the same position as the supporting surface of the cover element in the cover state in order to support the skiboot held in the skibinding downwardy on said surface.

This has the advantage that by moving the cover element away from the cover state, the supporting surface of the cover element can be moved away and the space occupied by the cover element in the cover state is freed up. As a result, this space can be occupied by a crampon held in the crampon holding device. Accordingly, when the cover element is moved away from the cover state, the surface of the crampon can replace the supporting surface of the cover element and serve to support the skiboot held in the skibinding downwardly on the surface of the crampon. In this way, a very compact design of the skibinding can be achieved.

This advantage can also be achieved in skibindings other than a ski binding described above as a skibinding according to the invention. Therefore, in a further invention which can be used independently of the skibinding described above as well as below, a skibinding is provided which skibinding has a bottom plate, the bottom plate having a crampon holding device for attaching and holding a crampon to the bottom plate, the bottom plate comprising a base element attachable to the ski and a cover element attachable to the base element, the cover element being movable to a cover state in which a supporting surface of the cover element is aligned in such a way that the skiboot held in the skibinding can be supported downwards on the supporting surface, the cover element being movable away from the cover state, in particular into an uncovered state, wherein, when the cover element is moved away from its cover state, in particular into the uncovered state, the crampon can be attached to the crampon holding device in order to be held by the crampon holding device. Advantageously, the crampon is attachable to the crampon holding device in such a way that a surface of the crampon is positioned at substantially the same position as the supporting surface of the cover element in the cover state in order to support the skiboot held in the skibinding downwardly on said surface.

A skibinding according to this further invention as well as a skibinding according to the invention initially described may comprise one or more of the following further features of the bottom plate.

Advantageously, the crampon holding device is arranged on the base element. This has the advantage that the skibinding can be constructed particularly easily. In a variant, however, it is also possible for the crampon holding device to be arranged on another element of the bottom plate, such as the cover element.

In the context of the skibinding with the convex supporting surface mentioned at the beginning, in the cover state of the cover element, the supporting surface of the cover element advantageously forms at least one part of the convex supporting surface. However, it is not necessary that in the cover state of the cover element, the supporting surface of the cover element forms at least one part of the convex supporting surface.

Preferably, the cover element is mounted on the base element so that it can be moved, in particular from the cover state to the uncovered state and back. Particularly preferably, the cover element is mounted on the base element so that it can be moved from the cover state to the uncovered state and back. This has the advantage that the cover element is always mounted on the base element and therefore cannot get lost. Alternatively, however, it is also possible for the cover element to be removable from the base element and attachable to the base element in the cover state. In a preferred variant, the cover element is mounted on the base element so as to be pivotable about an axis. In a preferred variant, the cover element is mounted on the base element so that it can be pivoted about the axis from the cover state to the uncovered state and back again. This has the advantage that the cover element can be mounted on the base element to be adjustable in a simple and stable manner.

In a further preferred variant, the cover element is mounted on the base element so that it can be slided, in particular in the longitudinal direction of the ski. Particularly preferably, the cover element is mounted on the base element so that it can be slided from the cover state to the uncovered state and back, in particular so that it can be slided along the longitudinal direction of the ski. This has the advantage that the cover element requires very little space for its adjustment.

Preferably, the bearing element has two bearing sections, which bearing sections extend away from the bearing element, particularly preferably away from the second pivot axis, in particular radially away from the second pivot axis, the bearing sections being spaced apart from each other such that a space is created between the bearing sections into which the skiboot can project and wherein the skiboot reception is provided at the free end of the bearing sections. Preferably, each free end has a pin which can engage in a corresponding bearing site on the skiboot.

Preferably, the two bearing sections are firmly coupled to each other mechanically. The coupling is such that the two bearing sections run parallel to each other during the movement into the pulling state.

The pins project from the free end of the bearing sections. The two pins are arranged collinearly to each other and define the first pivot axis.

In a preferred variant, the free end of the bearing sections is designed as a pivot arm with a joint, which pivot arm can be pivoted relative to the bearing section. The pivot arm is preferably designed in such a way that it is locked in a normal position and releases the shoe in the event of a safety opening in the event of a fall or other overload.

In a further preferred variant, the bearing sections are mounted so that they can be displaced essentially horizontally in the transverse direction of the ski relative to one another, in particular in a body of the bearing element. Preferably, the two bearing sections can be locked in a holding position, which can also be referred to as the normal position. In this holding position, the pins are preferably arranged at a distance from one another so that a skiboot can be held by the pins in its toe region so that the skiboot can pivot about the pins and thus about the first pivot axis. Starting from this holding position, the two pins can preferably be moved apart into a release position by moving the bearing sections apart horizontally in the transverse direction of the ski.

Preferably, the skibinding further comprises a heel locking element arranged in the direction of travel of the ski behind the support element. With the heel locking element, the rear area of the skiboot can be locked to the ski.

An arrangement includes a skiboot and a skibinding as described above, the tip of the skiboot having a bearing site for pivotal connection to the skiboot reception.

Preferably, the bearing site at the tip of the skiboot has a receptacle for receiving said pin, which is arranged at the skiboot reception.

Further, the arrangement may comprise a ski, wherein the skibinding is attached to the ski by the support element. By the expression ski may be meant an alpine ski, a touring ski, a cross-country ski, a telemark ski, or a ski part of a snowboard of divisible design.

Further embodiments are provided in the dependent claims.

Further advantageous embodiments and combinations of features of the invention result from the following detailed description and the totality of the patent claims.

BRIEF DESCRIPTION OF THE FIGURES

Preferred embodiments of the invention are described below with reference to the figures, which are for explanatory purposes only and are not to be construed restrictively. Shown in the figures.

Generally, the same parts are given the same reference signs in the figures.

WAYS TO CARRY OUT THE INVENTION

Figure 1A:
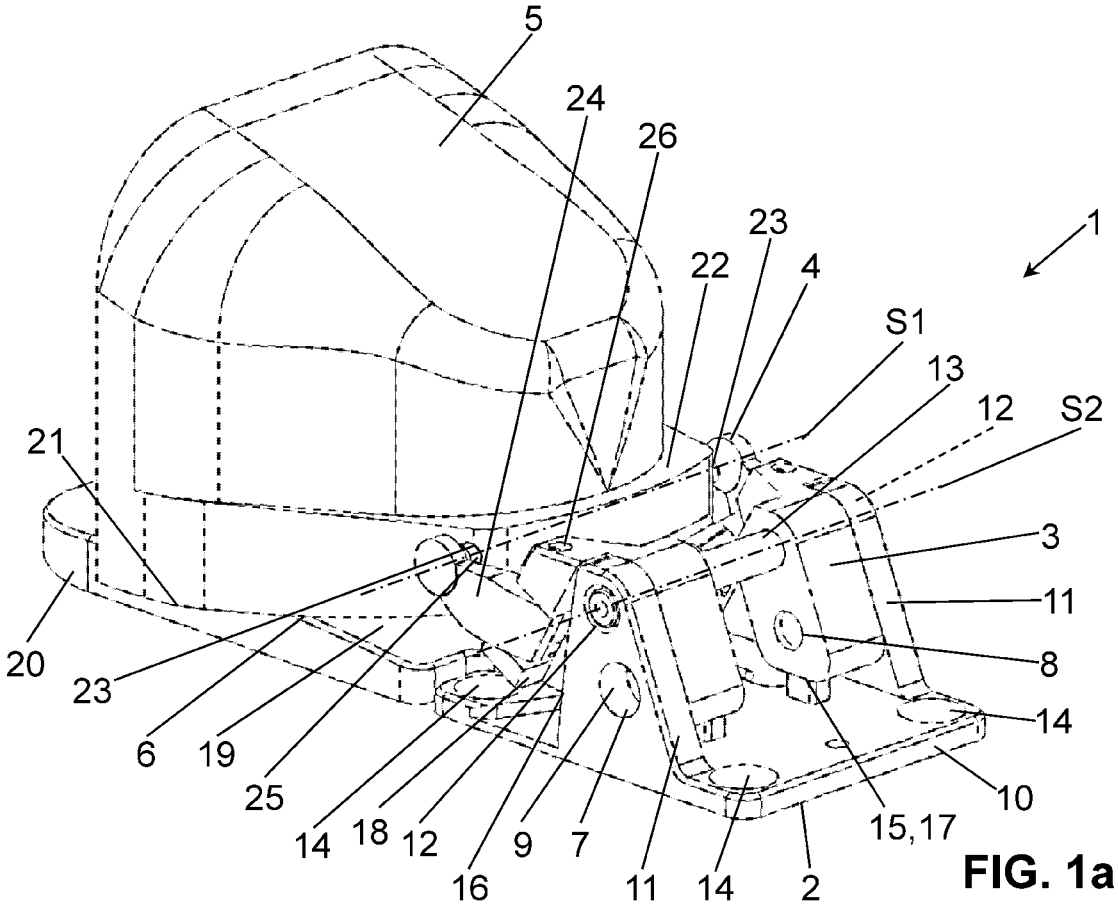
FIG. 1*a* a perspective view of a touring skibinding according to one embodiment of the present invention in the standing state.
Figure 1B:
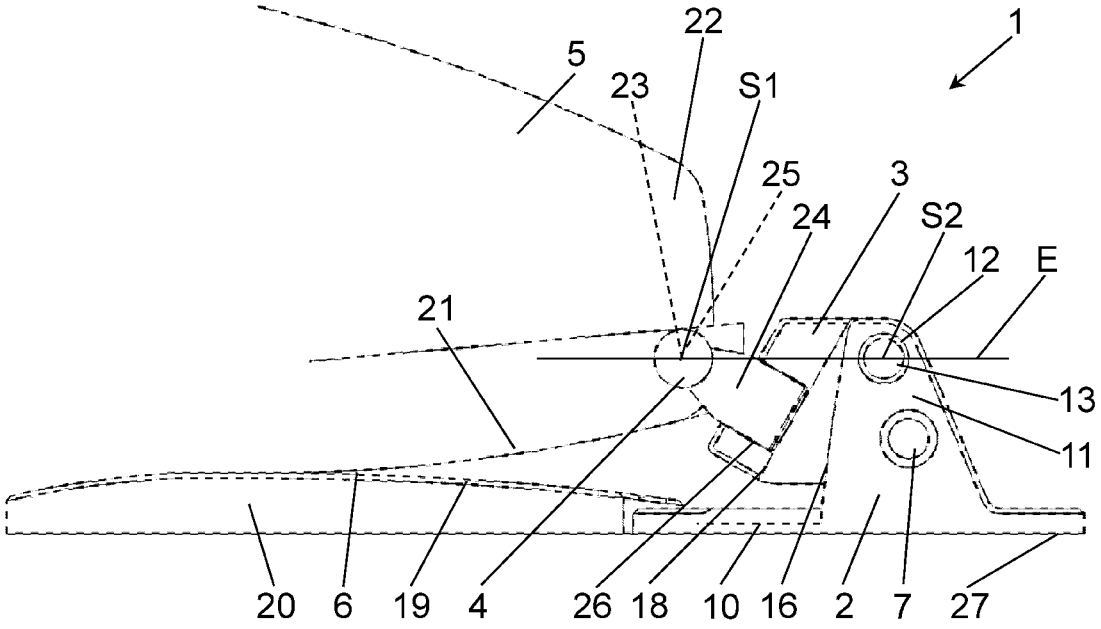
FIG. 1*b* a side view of the FIG. 1*a;*

FIGS. 1*a* to 5*b* show a skibinding 1 according to the invention. The skibinding is preferably a touring skibinding, an alpine ski binding, a telemark ski binding or a cross-country ski binding or a binding for a divisible snowboard.

The skibinding 1 comprises a support element 2 which can be attached to the ski, a bearing element 3 with a skiboot reception 4 which is designed in such a way that the skiboot 5 is mounted in the skiboot reception 4 so as to be pivotable about a first pivot axis S1 with respect to the skiboot reception 4, and a convex supporting surface 6 on which the skiboot 5 can roll. The bearing element 3 is pivotably connected to the support element 2 via a second pivot axis S2.

The support element 2 has a base plate 10. Two spaced bearing blocks 11 project from the top of the base plate 10. The underside of the base plate is a mounting surface 27 which rests on the upper surface of a ski not shown in the figures. The mounting surface is thus parallel to the surface of the ski. The base plate 10 includes a plurality of bearing openings 12 through which the support element 2 can be secured to the ski. The bearing blocks 11 provide the bearing sites for the pivotable mounting of the bearing element 3. The bearing element 3 can be pivoted relative to the support element 2. The bearing element 3 is partially located between the two bearing blocks 11.

Each of the bearing blocks 11 has a bearing opening 12. The bearing openings 12 are thereby arranged in alignment with one another. A bearing bolt 13 extends through the two bearing openings 12 and the space between the two bearing blocks 11. The bearing element 3 is mounted on the bearing bolt 13. The bearing bolt 13 defines the second pivot axis S2. In one variant, the bearing bolt 13 is pivotably mounted in the bearing openings 12 and the bearing element 3 is fixedly connected to the bearing bolt 13. In another variant, the bearing bolt 13 is fixedly mounted in the bearing openings 12 and the bearing element 3 has an opening through which the bearing bolt extends in such a way that the bearing element 3 can be pivoted to the bearing bolt 13.

The bearing element 3 is connected to the support element 2 so that it can be pivoted about the second pivot axis S2 from an initial state to a pivoted state. The skiboot reception 4 lies outside the space between the two bearing blocks 11.

As previously explained, the bearing element 3 is formed with a skiboot reception 4. In the embodiment shown, the bearing element 3 has two bearing sections 24, which bearing sections 24 extend away from the bearing element 3. In a preferred embodiment, the two bearing sections extend away from the second pivot axis S2, in particular radially away from the second pivot axis S2. In the embodiment shown, the two bearing sections 24 extend away from the bearing bolt 13. The two bearing sections 24 are spaced apart, such that a space is created between the bearing sections 24. The skiboot 5 can project into this intermediate space. Further, the skiboot reception 4 is located at the free end of the bearing sections 24. In the embodiment shown, the skiboot reception 4 has a pin 25 on each of the bearing sections 24, which projects into the intermediate space between the two bearing sections 24. The two pins 25 extend along the same axis and engage bearing sites 23 on the skiboot 5. The pins 25 and the engagement in the bearing sites 23 thereby define the first pivot axis S1. The bearing section 24 further comprises a joint 26, the free end being pivotable about the joint 26 so that the pin 25 can engage the bearing sites on the skiboot 5 via the joint 26. Preferably, the joint 26 and/or the bearing section 24 is blocked for movement from the standing state to the pulling state so that the skibinding cannot open.

The convex supporting surface 6 on which the skiboot 5 can roll is provided in the embodiment shown by a bottom plate 20 with a convex upper side 19 and by a convex underside 21 of the skiboot 5. The skiboot 5 can roll on the convex supporting surface 6.

The first pivot axis S1 runs parallel to the second pivot axis S2 and the first pivot axis S1 can be pivoted by a pivot angle $\alpha$ about the second pivot axis S2. The maximum pivot angle $\alpha$ of the first pivot axis S1 about the second pivot axis S2 is preferably in the range from 10° to 35°, in particular in the range from 20° to 30°.

The support element 2 has a first support element side stop surface 15 and a second support element side stop surface 16. The bearing element 3 has a first bearing element side stop surface 17 and a second bearing element side stop surface 18. In the initial state, the first bearing element side stop surface 17 abuts the first support element side stop surface 15, and in the pivoted state, the second bearing element side stop surface 18 abuts the second support element side stop surface 16.

Furthermore, the skibinding 1 preferably has a locking element 7 with which the bearing element 3 can be locked to the support element 2 so that pivoting between the bearing element 3 and the support element 2 is made impossible. The locking is then activated when the ski is used for a downhill run.

In the embodiment shown, the locking element 7 is provided by an opening 8 in the support element 2, an opening 9 in the bearing element 3 and a locking pin that can be pushed into the opening 8, 9. In the inserted state, the bearing element 3 is locked to the support element 2.

With reference to FIGS. 1*a* to 5*b*, the movement sequence of the skibinding 1 will now be explained in more detail.

Figure 5A:
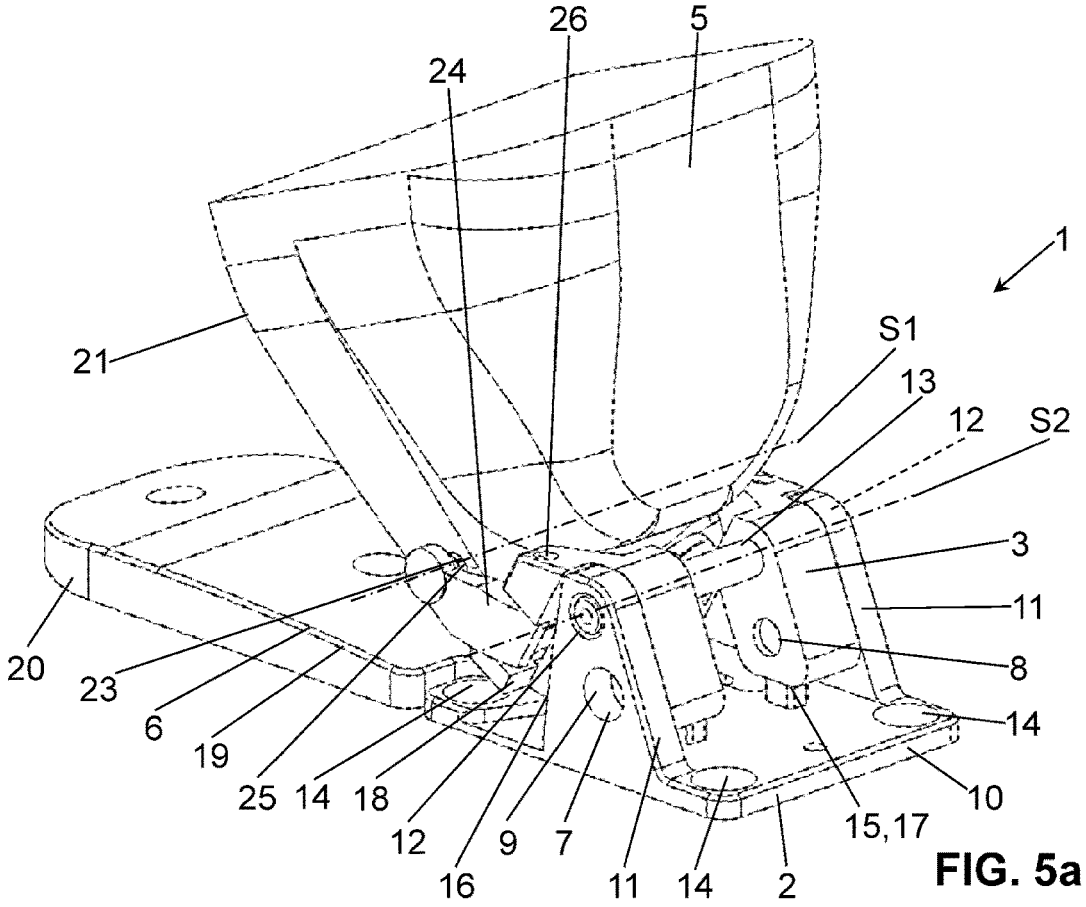
FIG. 5*a* a perspective view of a touring skibinding according to FIG. 1 in a pulling state.
Figure 5B:
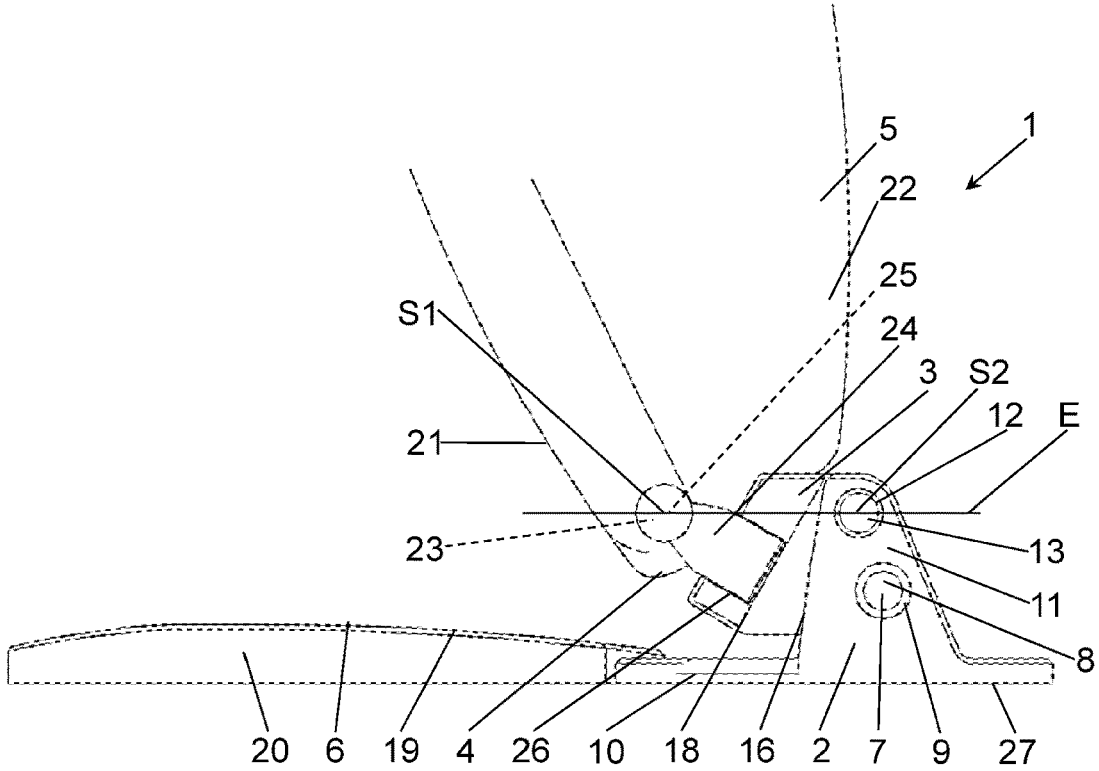
FIG. 5*b* a side view of the FIG. 5*a;*

In FIGS. 1*a*/1*b*, the skibinding 1 is shown in a standing state. The skier, in particular the ski tourer, stands with his foot flat in the skibinding 1. From the standing state, the roll process begins and the foot or the skiboot 5 moves into a pulling state, as shown in FIGS. 5*a*/5*b*.

Starting from the standing state, the skiboot 5 rolls on the convex supporting surface 6.

At the beginning of the roll process, the skiboot 5 rolls on the crowned surface 6. At the same time, a pivoting movement of the skiboot 5 about the first pivot axis S1 is executed or caused due to the connection between the skiboot 5 and the skiboot reception 4, respectively. Also simultaneously, a pivoting movement of the bearing element 3 about the second pivot axis S2 is effected or executed, respectively, whereby the bearing element 3 is pivoted from its initial state with respect to the support element 2 in the direction of its pivoted state. In other words, the tip 22 of the skiboot 5, pushes down the skiboot reception 4, resulting in said pivoting movements.

In the standing state, the first pivot axis S1 and the second pivot axis S2 span a reference plane E. When moving into the pulling state, the first pivot axis S1 is moved away from this reference plane E and back towards this reference plane E again. The reference plane E is substantially parallel to the underside of the base plate or substantially parallel to the surface of the ski on which the support element 2 is mounted, respectively. If the skier uses a climbing aid, the reference plane E can also run at an angle to the underside of the base plate or at an angle to the surface of the ski on which the support element 2 is mounted, respectively.

Figure 2A:
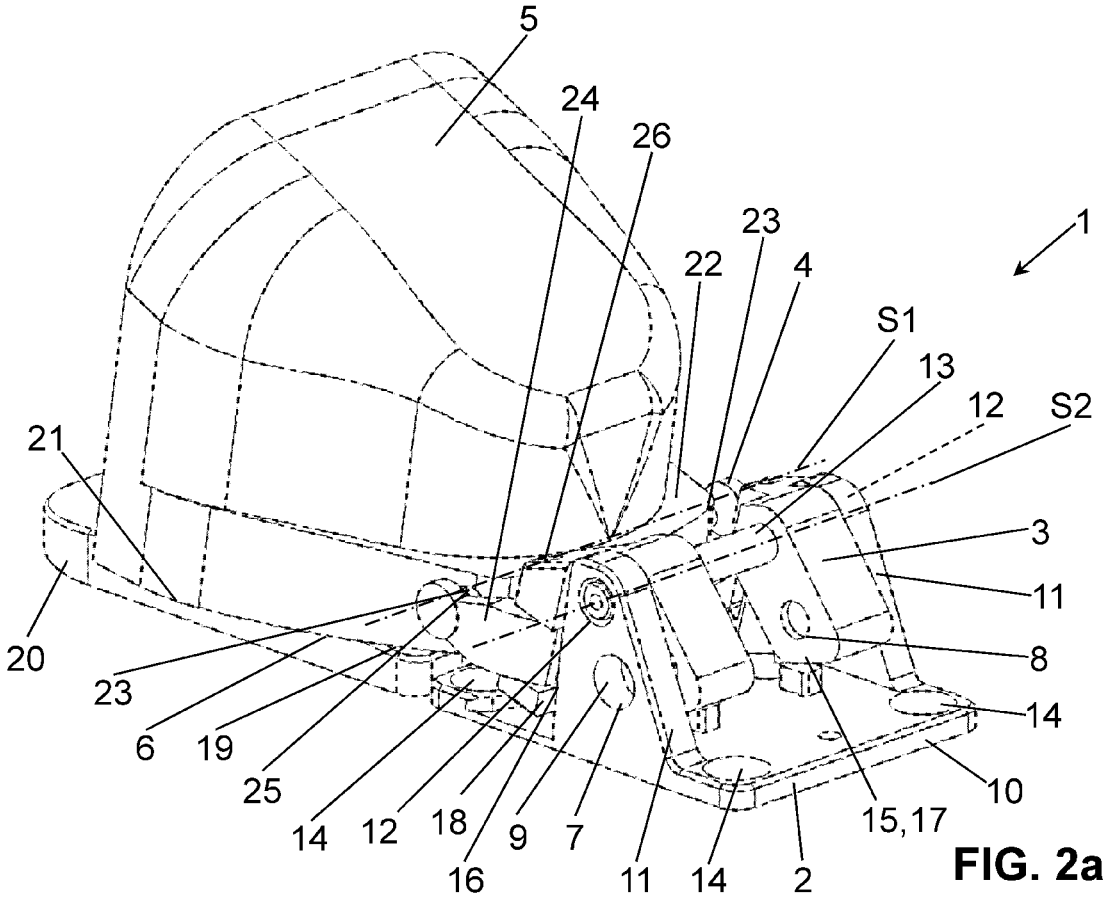
FIG. 2*a* a perspective view of a touring skibinding according to FIG. 1 during movement from the standing state to a pulling state.
Figure 2B:
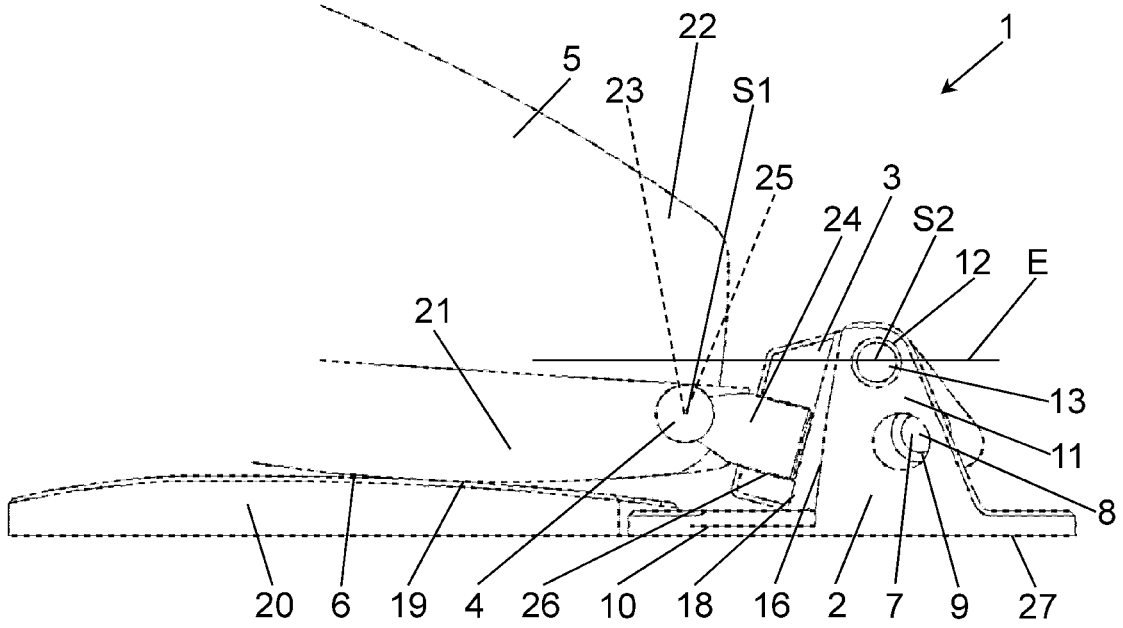
FIG. 2*b* a side view of the FIG. 2*a;*

FIGS. 2*a*/2*b* show very clearly how the skiboot 5 rolls on the convex supporting surface 6. The contact point between the skiboot 5 and the convex supporting surface moves towards the support element 2 as the roll process progresses from the standing state. At the same time, the skiboot 5 is further pivoted about the first pivot axis S1 relative to the bearing element 3. Also at the same time, the bearing element 3 is pivoted about the second pivot axis S2 relative to the support element 2, whereby the first pivot axis S1 is pivoted about the second pivot axis S2.

When the skiboot 5 moves into the pulling state, the skiboot 5 performs a pivoting movement about the first pivot axis S1 and the bearing element 3 and the first pivot axis S1 perform a pivoting movement about the second pivot axis S2. In the process, the boot reception 4 is pivoted downward with the first pivot axis S1 with respect to the second pivot axis S2 toward the support element 2. That is, the first pivot axis S1 is pivoted towards the upper side of a ski.

Figure 3A:
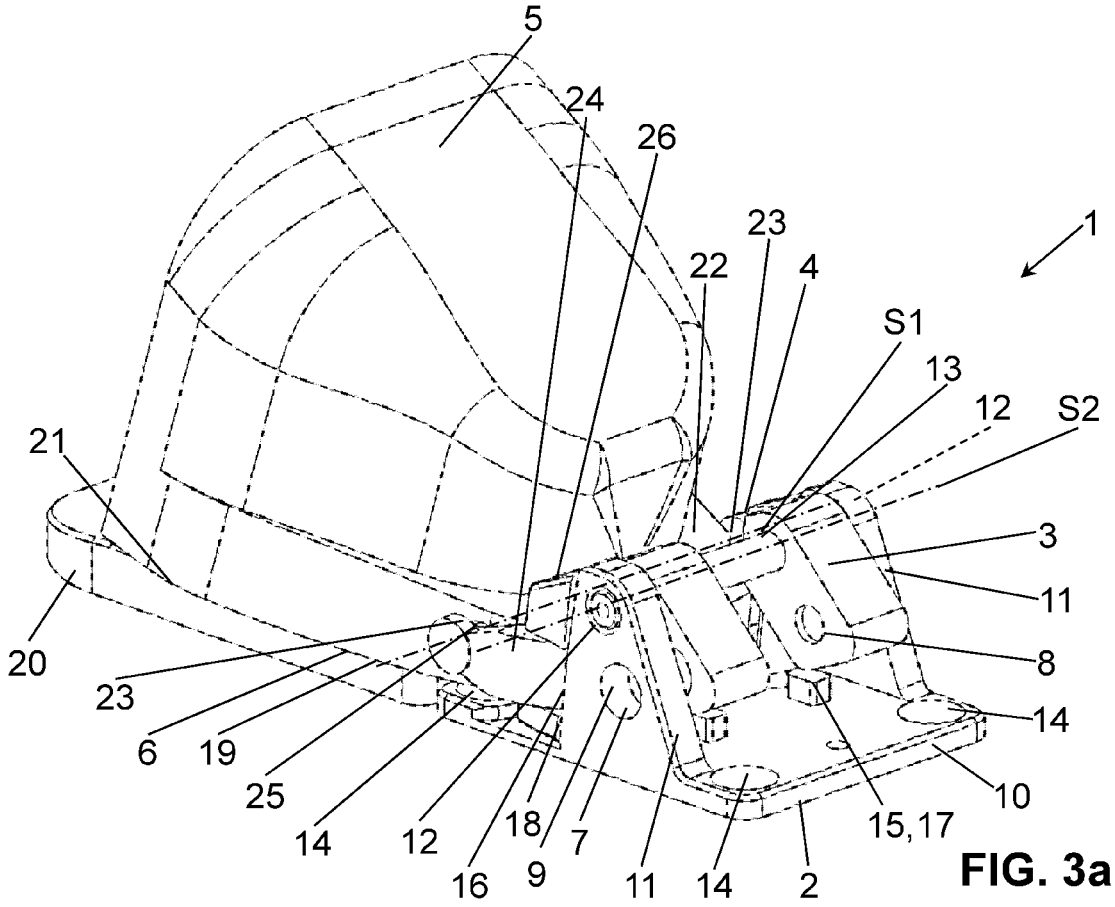
FIG. 3*a* a perspective view of a touring skibinding according to FIG. 1 during movement from the standing state to a pulling state.
Figure 3B:
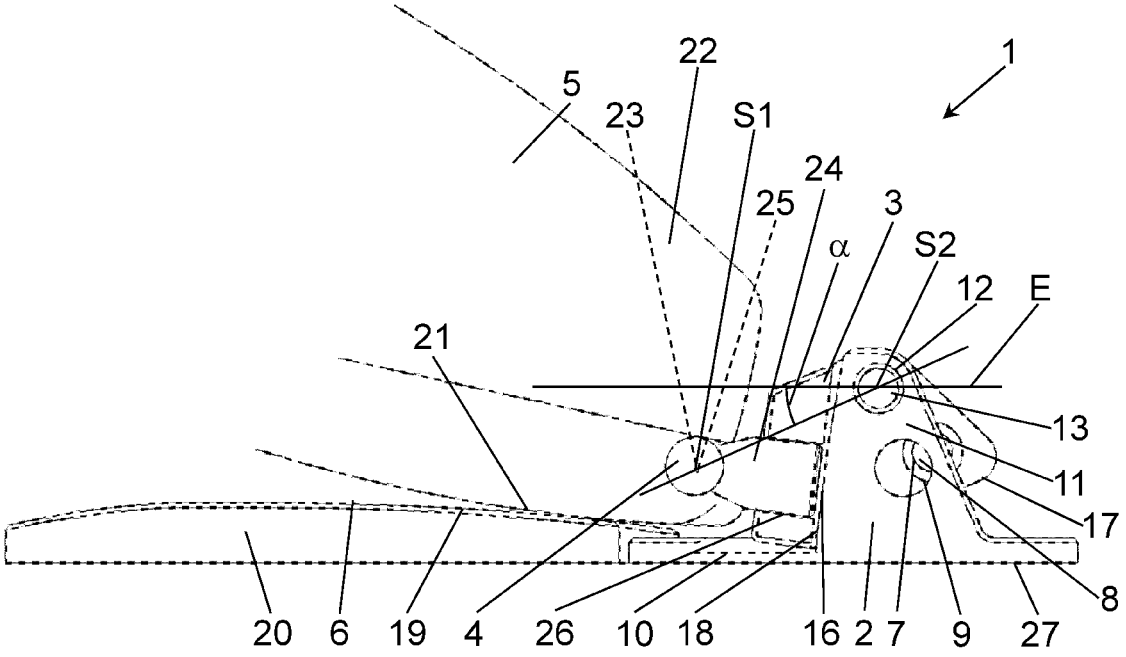
FIG. 3*b* a side view of the FIG. 3*a;*
Figure 4A:
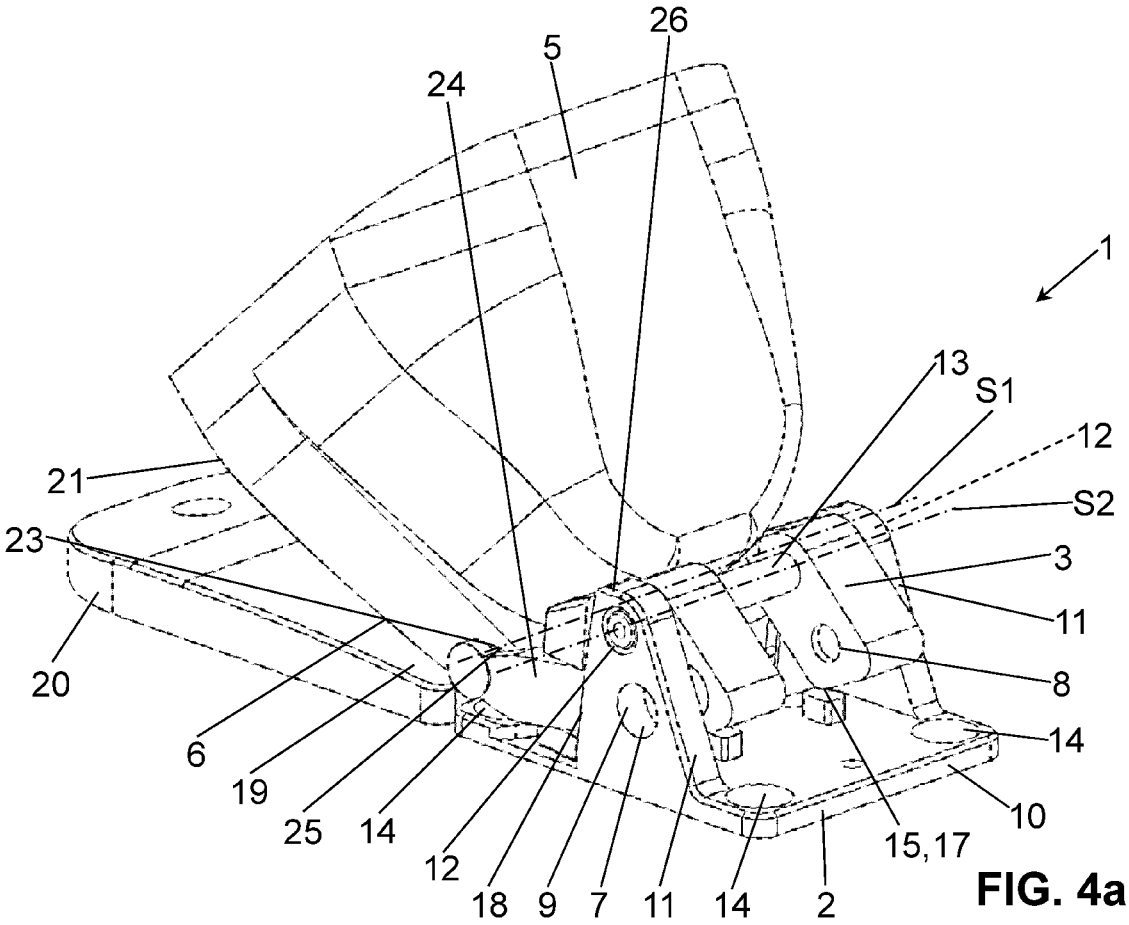
FIG. 4*a* a perspective view of a touring skibinding according to the figure during movement from the standing state to a pulling state.
Figure 4B:
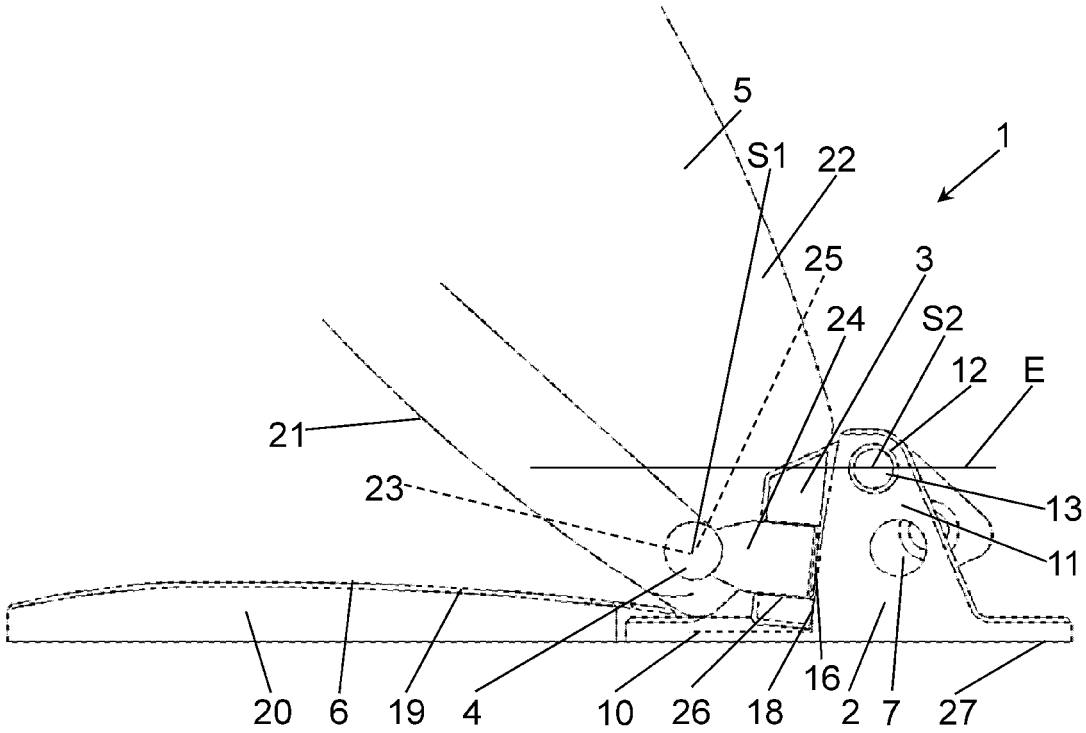
FIG. 4*b* a side view of the FIG. 4*a;*

FIGS. 3*a*/3*b* show a state between the standing state and the pulling state. In the state shown, which can also be referred to as the intermediate state, the roll process between the convex supporting surface 6 and the skiboot 5 is completed. Likewise, the pivoting movement about the second pivot axis S2 is completed. The second bearing element side stop surface 18 abuts the second support element side stop surface 16, whereby the bearing element 3 is abuts the support element 2. In the state shown, the maximum pivot angle of the bearing element 3 relative to the support element 2 has been reached. The pivot angle is indicated by the reference sign $\alpha$ in FIG. 3*b*.

Starting from the state shown in FIGS. 3*a*/3*b*, the skiboot 5 is now moved further in the direction of the pulling state. In the process, the skiboot 5 is pivoted further relative to the bearing element 3 about the first pivot axis. The skiboot 5 is further pivoted in the same pivoting direction as from the initial state into the intermediate state relative to the pivot mount 4. At the same time, a movement of the bearing element 3 takes place. In a first phase of the further movement into the pulling state, the bearing element 3 continues to abut the support element 2 in the pivoted state. In a second phase of the movement into the pulling state, the bearing element 3 is pivoted back to its initial state with respect to the support element, with the bearing element 3 resting with its first bearing element side stop surface 17 against the first support element side stop surface 15.

FIGS. 5*a*/5*b* show the pulling state. In the pulling state, the actual roll process of the skiboot 5 is completed and the skier will pull the ski accordingly. The bearing element 3 and also the skiboot 5 are then moved back to the standing state.

With this sequence of movements, in particular also due to the movement limitations at the stops, typical necessary movements such as sharp turns or short descents can also be executed without locking the heel, in a stable manner and without an unsteady standing feeling of the skier.

FIGS. 6 to 10*b* show a further skibinding 101 according to the invention, which is a touring skibinding. Thereby, in FIGS. 6 to 10*b*, only the front unit of the skibinding 101 is shown. However, the skibinding 101 also comprises a heel locking element which is arranged behind the support element 102 and behind the bottom plate 120 in the direction of travel of the ski. The heel locking element can be used to lock the rear portion of the skiboot to the ski. Such heel locking elements are known. An example of such a heel locking element is described in EP 3 195 906 A1 of Fritschi AG-Swiss Bindings. In EP 3 195 906 A1, the heel locking element is referred to as an automatic heel unit.

Figure 6:
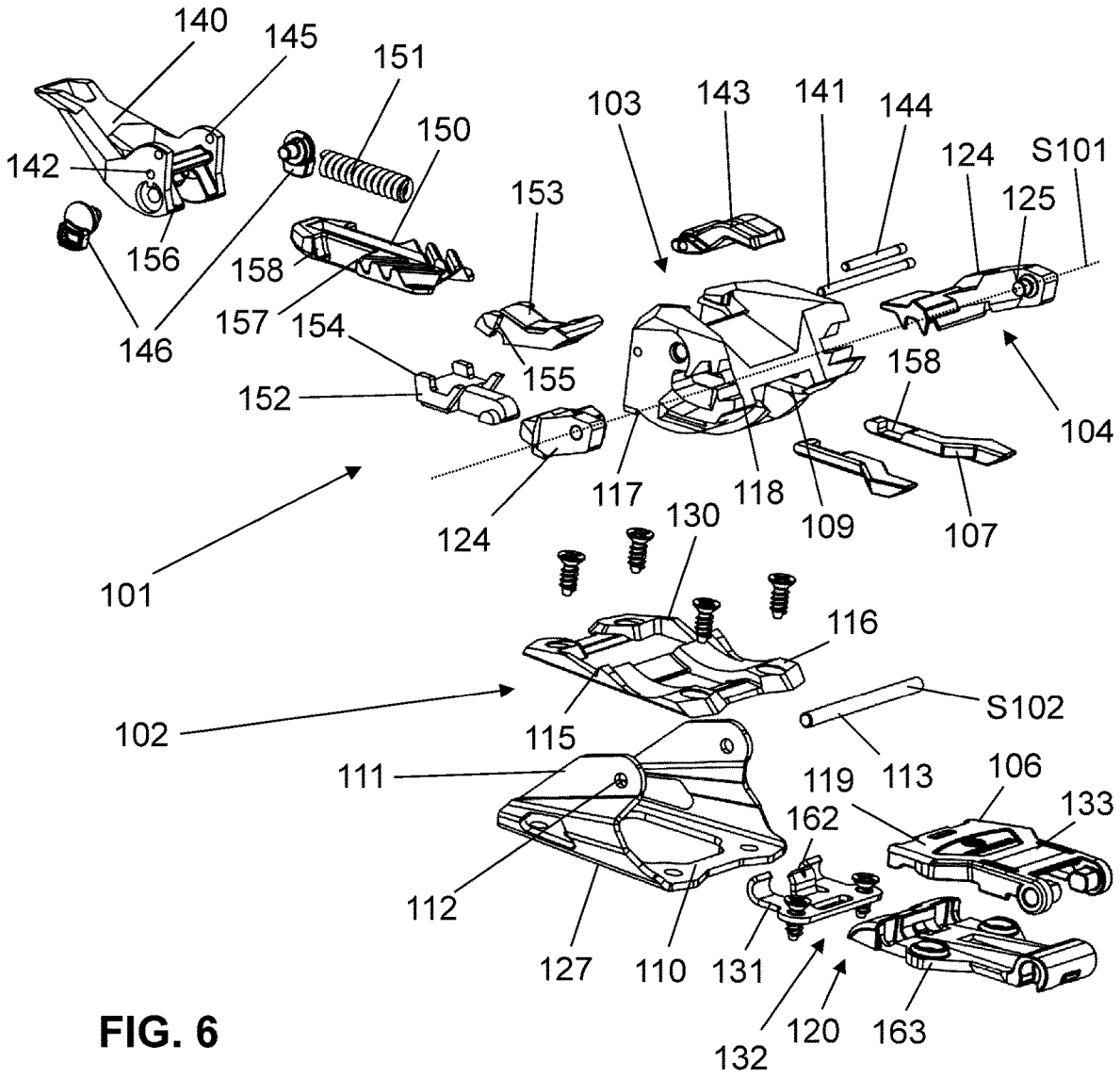
FIG. 6 an exploded view of a further skibinding according to the invention.

In FIG. 6, an exploded view is shown in an oblique view of the skibinding 101. Based on this illustration, the elements of the skibinding 101 are explained which correspond to elements of the skibinding 1 shown in FIGS. 1*a* to 5*b*. At the same time, however, deviations of the skibinding 101 shown in FIGS. 6 to 10*b* from the skibinding shown in FIGS. 1*a* to 5*b* are explained as well. Subsequently, the operation of the skibinding 101 is explained in more detail in the context of FIGS. 7*a* to 10*b*.

The skibinding 101 shown in FIGS. 6 to 10*b* comprises a support element 102 that can be attached to the ski and a bearing element 103 with a skiboot reception 104, which is designed in such a way that a skiboot not shown here can be mounted in the skiboot reception 104 such that it can pivot about a first pivot axis S101 with respect to the skiboot reception 104. Further, the skibinding 101 comprises a convex supporting surface 106 on which the skiboot can roll. The bearing element 103 is pivotally connected to the support element 102 via a second pivot axis S102.

The support element 102 has a base plate 110 and an insert element 130. This base plate 110 is formed by a metal plate, the ends of which are bent upward to form two bearing blocks 111. Thus, the bearing blocks 111 protrude from the top of the base plate 110 in a spaced-apart relationship. The underside of the base plate 110 forms a mounting surface 127, which rests on the upper surface of a ski not shown in the figures. The mounting surface 127 is thus parallel to the surface of the ski. The insert element 130 is arranged between the two bearing blocks 111 on the base plate 110. The base plate 110 and the insert element 130 each comprise a plurality of openings for the passage of fastening screws, via which the support element 102 can be fastened to the ski. In each case, the fastening screws are first passed through one of the openings in the insert element 130 and then through one of the openings in the base plate 110 before being screwed into the ski.

The bearing blocks 111 provide the bearing sites for the pivotable mounting of the bearing element 103. This allows the bearing element 103 to be pivoted relative to the support element 102. The bearing element 103 is partially located between the two bearing blocks 111. Each of the bearing blocks 111 has a bearing opening 112. The bearing openings 112 are thereby arranged in alignment with one another. A bearing bolt 113 extends through the two bearing openings 112 and the space between the two bearing blocks 111. The bearing element 103 is mounted on the bearing bolt 113. The bearing bolt 113 defines the second pivot axis S102. In one variant, the bearing bolt 113 is pivotally mounted in the bearing openings 112 and the bearing element 103 is fixedly connected to the bearing bolt 113. In another variation, the bearing bolt 113 is fixedly mounted in the bearing openings 112 and the bearing element 103 has an opening through which the bearing bolt extends such that the bearing element 103 is pivotable relative to the bearing bolt 113.

The bearing element 103 is connected to the support element 102 so as to be pivotable about the second pivot axis S102 from a downhill state to a pivoted state, the bearing element 103 being movable first to an initial state and further from the initial state to the pivoted state during a continuous pivoting movement from the downhill state to the pivoted state. That is, the initial state is between the downhill state and the pivoted state. The skiboot reception 104 is located outside the space between the two bearing blocks 111.

As previously explained, the bearing element 103 is formed with a skiboot reception 104. In the embodiment shown, the bearing element 103 has two bearing sections 124, which bearing sections 124 extend away from the bearing element 103 and away from the second pivot axis S102. Thus, the two bearing sections 124 extend away from the bearing bolt 113. The two bearing sections 124 are spaced apart, such that a space is created between the bearing sections 124. The skiboot can project into this intermediate space. Furthermore, the skiboot reception 104 is located at the free end of the bearing sections 124. In the embodiment shown, the skiboot reception 104 has a pin 125 on each of the bearing sections 124, which projects into the intermediate space between the two bearing sections 124. The two pins 125 extend along a same axis and engage bearing sites on the skiboot when the skiboot is held in the skibinding 101. The pins 125 and the engagement with the bearing sites thereby define the first pivot axis S101, which is shown as a dotted line in FIG. 6. The bearing sections 124 are mounted for horizontal displacement in the transverse direction of the ski in a body of the bearing element 103. This allows the pins 125 to be moved apart to an entry position. In this entry position, the two pins 125 are moved sufficiently far apart so that the tip of the skiboot can be guided between the pins 125. Further, the pins 125 can be moved towards each other starting from the entry position into a holding position. When the tip of the skiboot is located between the pins 125, the pins 125 can thereby engage the bearing sites on the skiboot and hold the skiboot pivotably about the first pivot axis S101. This movement of the bearing sections 124 with the pins 125 apart into the entry position and towards each other into the holding position is achieved by means of a slider 150, similar to that described in EP 3 566 754 A1 of Fritschi AG-Swiss Bindings. For this purpose, the skibinding 101 comprises the slider 150 and an elastic element 151 in the form of a spiral spring. Both the slider 150 and the elastic element 151 are arranged substantially aligned in the longitudinal direction of the ski in the body of the bearing element 103, and are accordingly pivotable together with the bearing element 103 about the second pivot axis S102. The elastic element 151 is arranged in front of the first pivot axis S101, as seen in the longitudinal direction of the ski. Towards the rear, the elastic element 151 is abutted against the body of the bearing element 103 and towards the front against the slider 150. In the assembled state of the skibinding 101, the elastic element 151 is biased and pushes the slider 150 forward relative to the body of the bearing element 103. In the presently shown embodiment, the bias of the elastic element 151 is predetermined by the shape of the body of the bearing element 103 and the slider 151. However, in variations thereon, the preload of the elastic element 151 is adjustable. This can be achieved, for example, by means of a screw or a combination of a screw with a nut, as is known from the technical field of skibindings.

The slider 150 extends below the elastic element 151 backward to below the two bearing sections 124, with the slider 150 having a third guide shape below the first bearing section 124 and a fourth guide shape below the second bearing section 124. Both the third guide shape and the fourth guide shape are formed by grooves extending diagonally laterally forward from the center of the ski. Further, the first bearing section 124 has a first guide shape on its underside, while the second bearing section 124 has a second guide shape on its underside. Thereby, the first guide shape is formed complementary to the third guide shape, while the second guide shape is formed complementary to the fourth guide shape. In the assembled state of the skibinding 101, the first guide shape cooperates with the third guide shape, while the second guide shape cooperates with the fourth guide shape. Thus, the slider 150 is operatively connected to the first bearing section 124 by the interaction of the first guide form with the third guide form, and is operatively connected to the second bearing section 124 by the interaction of the second guide form with the fourth guide form. Thus, when the slider 150 is displaced, the first guide shape is displaced relative to the third guide shape and the second guide shape is displaced relative to the fourth guide shape. Therefore, by displacing the slider 150 in a first direction forward in the longitudinal direction of the ski, the first bearing section 124 and the second bearing section 124 are displaced relative to each other, thereby also moving the first pin 125 and the second pin 125 toward each other, toward their holding position. Since the slider 150 is biased forward by the biased elastic element 151, the two pins 125 are thus biased toward each other toward their holding position.

However, the slider 150 is also operatively connected to the first bearing section 124 and the second bearing section 124 such that movement of the first bearing section 124 and the second bearing section 124 relative to each other, which moves the two pins 125 apart from their holding positions, moves the slider 125 in a second direction opposite to the first direction. At the same time, moving the slider 150 in the second direction opposite the first direction moves the first bearing section 124 and the second bearing section 124 relative to each other, thereby moving the first and second pins 125 away from each other away from their holding position.

Furthermore, as described below in connection with FIGS. 9*a* to 9*d*, the bearing sections 124 can be locked in place relative to the body of the bearing element 103 so that the skibinding cannot open and the skiboot can be moved from the standing state to the pulling state during walking without disengaging from the skibinding 101.

In the skibinding 101 shown in FIGS. 6 to 10*b*, the convex supporting surface 106 on which the skiboot can roll is formed by a three-part bottom plate 120 or by the three-part bottom plate 120 together with any crampon 160 attached to the bottom plate 120. Whether or not the crampon 160 is attached to the bottom plate 120, the bottom plate 120 is attached to the ski by screws behind the support element 102. This three-part bottom plate 120 has a base element 132 formed by a base sheet 131 and a bottom element 163. In the assembled state, the bottom element 163 is arranged above the base sheet 131. Furthermore, the bottom plate 120 has a cover element 133. The base plate 131 and the bottom element 163, which together form the base element 132, each have two openings for the screws to pass through. In each case, a screw is passed through one of the openings in the base element 163 and then through one of the openings in the base sheet 131 before being screwed tight in the ski. The cover element 133 is mounted on the base element 132 at its rear end so that it can pivot about an axis. In a forward tilted state of the cover element 133, the cover element 133 is in a cover state. In this cover state, a supporting surface 161 of the cover element 133 is oriented such that the skiboot held in the skibinding can be supported downwardly on the supporting surface 161. When the cover element 133 is in this cover state, the base element 132 and the supporting surface 161 of the cover element 133 together form a convex upper side 119 which forms the convex supporting surface 106. The skiboot can roll on this convex supporting surface 106. However, the cover element 133 can also be pivoted backward about its axis relative to the base element 132 into an uncovered state. This opens access to a crampon holding device 162 formed by the base sheet 131. A crampon 160 can be attached to this crampon holding device 162 as illustrated in FIGS. 9*a* to 10*b* when the cover element 133 is pivoted rearwardly relative to the base element 132 into its uncovered state. When the crampon 160 is so attached to the crampon holding device 162, the bottom element 163 and a surface of the crampon 160 together form the convex supporting surface 106 when the crampon 160 is lowered toward the ski as illustrated in FIGS. 9*a* through 9*d*. Thus, the crampon 160 is attachable to the crampon holding device 162 such that a surface of the crampon 160 is positioned at substantially the same position as the supporting surface 161 of the cover element 133 is in the cover state to downwardly support the skiboot held in the skibinding 101. However, in a variation on the pivotable cover element 133, the cover element may also be slidably mounted to the base element. For example, the cover element can be mounted on the base element so as to be slidable in the longitudinal direction of the ski from its cover state to its uncovered state. In a further variant, however, it is also possible for the cover element to be attachable to the base element in the cover state and removable from the base element in order to free up the space for attaching the crampon 160 to the crampon holding device 162.

The first pivot axis S101 runs parallel to the second pivot axis S102 and can be pivoted through a pivot angle about the second pivot axis S102. The maximum pivot angle of the first pivot axis S101 about the second pivot axis S102 is 32.12° in the present embodiment. During such a pivoting movement of the first pivot axis S101 about the second pivot axis S102, the bearing element 103 is pivoted about the second pivot axis S102. In a first end position of this pivoting movement, the bearing element 103 is in the downhill state. In a second end position of this pivoting movement, the bearing element 103 is in the pivoted state. In the downhill state, the pins 125 are 19 mm higher above the ski than in the pivoted state. That is, during a pivoting movement of the bearing element 103 about the second pivot axis S102, a height of the pins 125 above the ski is adjusted by a maximum of 19 mm.

When the skiboot is held in the skibinding 101 in the ascent configuration and is in the standing state, i.e. with the heel of the skiboot lowered to the maximum towards the ski and with the ball of the skiboot supported on the bottom plate 120, the bearing element 103 is in the initial state. If the ski boot is an average touring ski boot, in this initial state of the bearing element 103, the pins 125 are 16 mm higher above the ski than in the pivoted state of the bearing element 103. In addition, the pins 125 are 3 mm lower above the ski than in the downhill state of the bearing element 103. However, since different ski boots are shaped differently in their front region, the pins 125 may also be at a slightly different height above the ski in the initial state of the bearing element 103 when the respective ski boot is in the standing state. For example, the pins 125 may be 14 mm higher above the ski in the initial state of the bearing element 103 than in the pivoted state, depending on the skiboot. Also, depending on the skiboot, the pins 125 in the initial state of the bearing element 103 may be, for example, 17 mm higher above the ski than in the pivoted state.

The support element 102 has a first support element side stop surface 115 and a second support element side stop surface 116. The bearing element 103 has a first bearing element side stop surface 117 and a second bearing element side stop surface 118. In the downhill state, the first bearing element side stop surface 117 abuts the first support element side stop surface 115, and in the pivoted state, the second bearing element side stop surface 118 abuts the second support element side stop surface 116. This limits the pivot movement of the bearing element 103 about the second pivot axis S102.

Furthermore, the skibinding 101 has two locking elements 107 with which the bearing element 103 can be locked in the downhill state with respect to the support element 102, so that pivoting between the bearing element 103 and the support element 102 is made impossible. This locking mechanism can be activated when the ski is used for a downhill run.

In the embodiment shown in FIGS. 6 to 10*b*, the locking elements 107 are guided in slits 109 in the body of the bearing element 103. By being pushed backwards in the slits 109, the locking elements 107 protrude backwards from the body of the bearing element 103 and bear downwards against the second support element side stop surface 116. In this position, the first bearing element side stop surface 117 abuts the first support element side stop surface 115, too. Since the first bearing element side stop surface 117 and the first support element side stop surface 115 are located in front of the second pivot axis S102, while the second support element side stop surface 116 is located behind the second pivot axis S102, the bearing element 103 is thereby locked in the downhill state. To release this locking, the locking elements 107 can be pushed forward in the slits 109. This releases the pivoting movement of the bearing element 103 relative to the support element 102, so that the bearing element 103 can be pivoted from the downhill state to the pivoted state, where the second bearing element side stop surface 118 abuts the second support element side stop surface 116.

The skibinding 101 described in FIGS. 6 to 10*b* comprises an actuating lever 140, which is mounted on the body of the bearing element 103 pivotally about an actuating lever axle 141 aligned horizontally in the transverse direction of the ski. This actuating lever axle 141 extends through an actuating lever axle opening 142 in the actuating lever 140. Above the actuating lever axle opening 142, a release lever axle opening 145 is formed in the actuating lever 140, in which release lever axle opening 145 a release lever 143 is mounted on the actuating lever 140 pivotally about a release lever axle 144 oriented horizontally in the transverse direction of the ski. Below the actuating lever axle opening 142, a pivot element 146 is mounted on each side of the actuating lever 140 so as to pivot about an axis aligned horizontally in the transverse direction of the ski. These two pivot elements 146 have downward-pointing knobs below their axle bearings, with which they each engage in recess 158 in a front region of one of the two locking elements 107.

As a result, depending on the position of the actuating lever 140, the locking elements 107 can be slided in the body of the bearing element 103 by a movement of the actuating lever 140.

Further, the skibinding 101 comprises a connecting slider 152 slidably substantially in the longitudinal direction of the ski in the body of the bearing element 103 below the slider 150. At a rear end of the connecting slider 152, a step spur 153 is pivotally mounted about an axis aligned horizontally in the transverse direction of the ski. This step spur 153 serves to adjust the skibinding from an entry position, in which the pins 125 are in the entry position, to a holding position, in which the pins 125 are in the holding position.

At its front end, the connecting slider 152 has two upwardly pointing cams 154 which, when assembled, extend upwardly from below into downwardly open recesses on an underside of the actuating lever 140. However, these downwardly open recesses on the underside of the actuating lever 140 are not visible in the figures.

When the actuating lever 140 is pulled upward with its forwardly pointing free actuating end, the downwardly open recesses on the underside of the actuating lever 140 are moved forward. As soon as the upward-pointing cams 154 of the connecting slider 152 abut the rear sides of the downward-open recesses on the underside of the actuating lever 140, the connecting slider 152 is thereby also pulled forward together with the step spur 153. On the other hand, when the actuating lever 140 is moved with its forwardly pointing free actuating end downward toward the ski, the downwardly open recesses on the underside of the actuating lever 140 are moved rearwardly. As a result, due to the upward pointing cams 154 of the connecting slider 152, the connecting slider 152 and thus also the step spur 153 are moved backward.

Figure 7A:
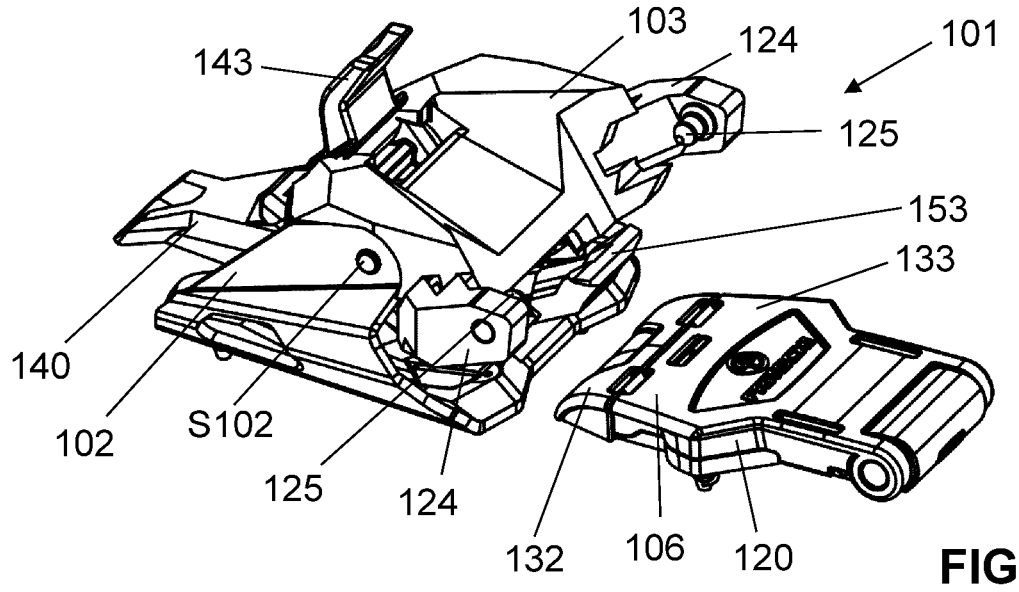
FIG. 7*a* an oblique view of the further skibinding according to the invention in an entry configuration.

FIG. 7*a* shows an oblique view of the skibinding 101 in the entry configuration. In the illustration, it can be seen that the forward free actuating end of the actuating lever 140 is lowered towards the ski, while the pins 125 are in their entry position. The step spur 153 is located below the pins 125 and points obliquely upwards to the rear.

Figure 7B:
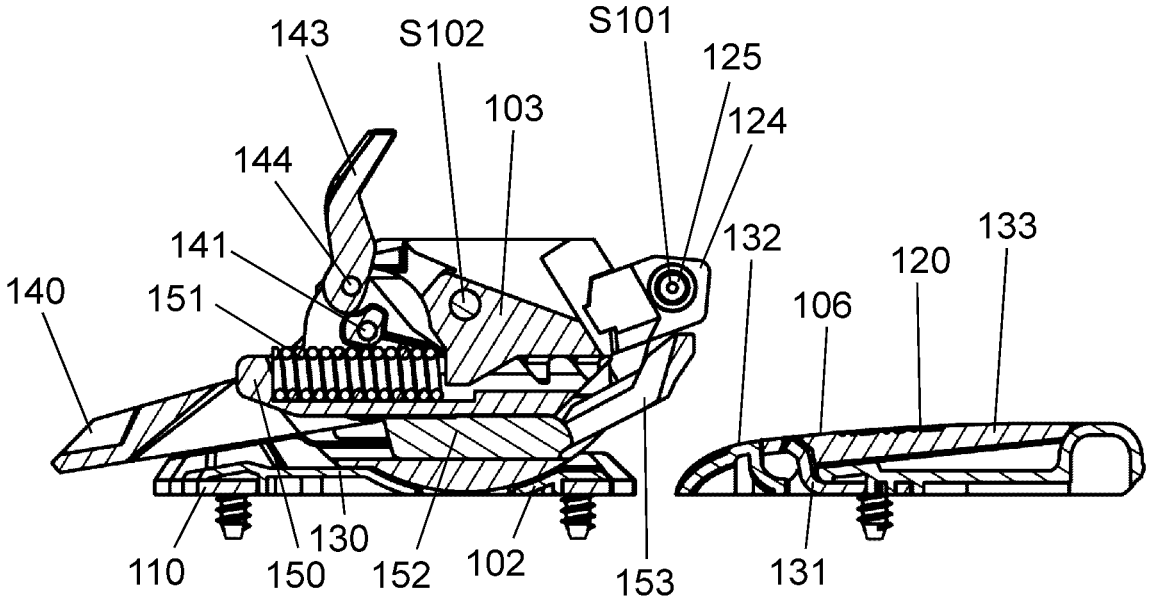
FIG. 7*b* a view of a cross-section extending vertically in the longitudinal direction of the ski through the further skibinding according to the invention in the entry configuration.

FIG. 7*b* shows a cross-section through the skibinding 101 in the entry configuration running vertically in the longitudinal direction of the ski. This shows the elastic element 151 biased between the slider 150 and the body of the bearing element 103. In addition, it can be seen how the connecting slider 152 is arranged below the slider 151 so as to be displaceable in the longitudinal direction of the ski in the body of the bearing element 103. It can be seen that the connecting slider 152 is in a rear position in the body of the bearing element 103.

In the entry configuration shown in FIGS. 7*a* and 7*b*, the locking elements 107 are slid rearward in the slits 109, project rearward from the body of the bearing element 103, and abut downward against the second support element side stop surface 116. As already described, in this position of the locking elements 107, the first bearing element side stop surface 117 simultaneously abuts the first support element side stop surface 115. As a result, the bearing element 103 is locked in the downhill state because the first bearing element side stop surface 117 and the first support element side stop surface 115 are located in front of the second pivot axis S102, while the second support element side stop surface 116 is located behind the second pivot axis S102.

In the absence of external force, the skibinding 101 remains in the entry configuration even though the elastic element 151 is biased between the body of the bearing element 103 and the slider 150. This is achieved by the actuating lever 140 having a stop 156 on its rear side below the actuating lever axle 143. This stop 156 can be seen in FIG. 6 and cooperates with a first counterstop 157 arranged on the slider 150, which can also be seen in FIG. 6. In the entry configuration, the stop 156 on the actuating lever 140 and the first counterstop 157 on the slider 150 are aligned with each other in such a way that the slider 150, which is pressed forward by the elastic element 151, causes a force on the actuating lever 140 that is directed obliquely forward and upward toward the actuating lever axle 141. Since the actuating lever axle 141 is supported in the body of the bearing element 103, against which the elastic element 151 also abuts, it is achieved that in the entry configuration no torque is caused on the actuating lever 140 by the elastic element 151 and that the skibinding remains in the entry configuration without external force being applied.

As can be seen in FIGS. 7*a* and 7*b*, the release lever 143 is substantially vertical upward in the entry configuration. Here, as already mentioned, the release lever 143 is mounted on the actuating lever 140 so that it can pivot about the release lever axle 144. Here, a leg spring is wound around the release lever axle and biases the release lever 143 relative to the body of the bearing element 103 so that its upwardly pointing free end is biased rearwardly. However, in the entry configuration, the release lever 143 is held in its substantially vertical orientation because its lower end is supported on the body of the bearing element 103. This prevents the release lever 143 from being pivoted rearwardly by the leg spring. In a variation on this, however, it is also possible for the release lever 143 not to be biased by a leg spring. In this case, the orientation of the release lever 143 can also be controlled by a portion of the release lever abutting against the body of the bearing element 103.

If a skiboot is inserted with its tip between the pins 125 and moved downward so that the step spur 153 is pushed downward by the sole of the skiboot, a stop 155 located on the step spur 153 and shown in FIG. 6 abuts inside the body of the bearing element 103 so that the step spur 153 is moved forward with its front bottom side. This causes the connecting slider 152 to be pushed forward. This causes the actuating lever 140 to be moved slightly upward with its free actuating end by the upwardly facing cams 154 of the connecting slider 152, as described above. This rotation of the actuating lever 140 with its free actuating end slightly upward causes the alignment of the stop 156 arranged on the actuating lever 140 to change with respect to the first counterstop 157 arranged on the slider 150. This also causes the force acting on the actuating lever 140, which is caused by the slider 150 being pushed forward by the elastic element 151, to change its orientation and point more flatly forward. Once the orientation of this force is lowered sufficiently and points forward below the actuating lever axle 141, a sufficiently large torque is caused to act on the actuating lever 140 so that the actuating lever 140 is pivoted with its free actuating end upward until the free actuating end points forward substantially horizontally.

During this rotary movement of the actuating lever 140, the two pivot elements 146, which are pivotably mounted on the actuating lever 140 and can be seen in FIG. 6, are also moved. However, the two pivot elements 146 are pivoted relative to the actuating lever 140 so that their downward-pointing knobs rotate in the recesses 158 in the front area of one of the two locking elements 107. Therefore, the locking elements 107 are not displaced relative to the body of the bearing element 103 and thus remain in their locking position, in which they protrude rearwardly beyond the body of the bearing element 103 and bear downwardly against the second support element-side stop surface 116. This continues to prevent pivotal movement of the bearing element 103 relative to the support element 102, and the bearing element 103 remains locked in its downhill state.

However, with the rotational movement of the actuating lever 140 described above until the free actuating end of the actuating lever 140 points substantially horizontally forward, the slider 150 in the body of the bearing element 103 is also pushed forward so that the two bearing sections 124 are moved toward each other and the two pins 125 are moved into their holding position, in which they engage the bearing sections on the skiboot and can hold the skiboot pivotably about the first pivot axis S101. In this position, the skibinding is in a downhill configuration.

Figure 8A:
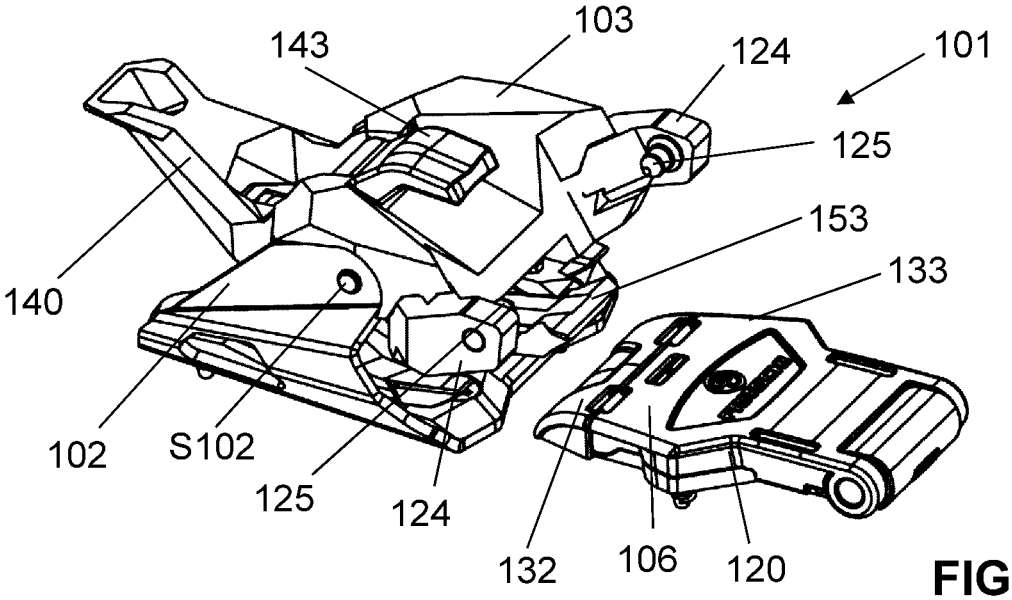
FIG. 8*a* an oblique view of the further skibinding according to the invention in a downhill configuration.

FIG. 8*a* shows an oblique view of the skibinding 101 in the downhill configuration. In the downhill configuration, the bearing element 103 is locked in its downhill state due to the position of the locking elements 107 in their rear position, as already mentioned. Accordingly, the bearing element 103 cannot be pivoted about the second pivot axis S102 relative to the support element 103.

In the illustration of FIG. 8*a*, it can be seen that in the downhill configuration, the forward-facing free actuating end of the actuating lever 140 points essentially horizontally forward, while the pins 125 are in their holding position. In this case, the step spur 153 is still located below the pins 125. However, its rearward facing free end is lowered compared to the entry configuration and points substantially horizontally rearward. This can be seen in particular in FIG. 7*b*, which shows a cross-section through the skibinding 101 in the entry configuration running vertically in the longitudinal direction of the ski.

Figure 8B:
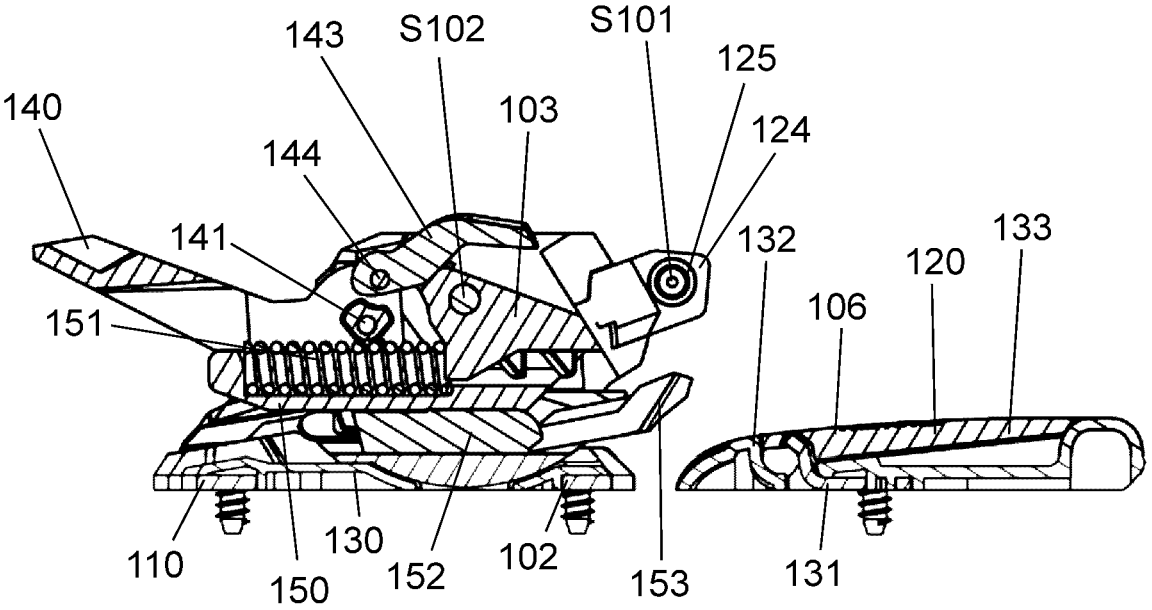
FIG. 8*b* a view of a cross-section extending vertically in the longitudinal direction of the ski through the further skibinding according to the invention in the downhill configuration.

As can be seen in FIG. 8*b* compared to FIG. 7*b*, the slider 150 and connecting slider 152 are moved further forward in the body of the bearing element 103 in the downhill configuration than in the entry configuration. Due to the change in position of the slider 150, the elastic element 151 is less biased in the downhill configuration than in the entry configuration.

Further, it can be seen in FIG. 8*b* that, in contrast to the entry configuration shown in FIG. 7*b*, the release lever 143 is oriented substantially horizontally rearward in the downhill configuration. This is because, due to the pivoting movement of the actuating lever 140 relative to the body of the bearing element 103, the release lever axle 144 is also positioned differently relative to the body of the bearing element 103. As a result, the release lever 143 is no longer supported on the body of the bearing element 103 in the same manner as in the entry configuration. Therefore, the release lever 143 has now been pivoted by the leg spring and has its free end pointing rearward. Accordingly, in the downhill configuration, the release lever axle 144 is located in the front portion of the release lever 143, while a central portion of the release lever 143 is supported downwardly on the body of the bearing element 103 in the region of the second pivot axis S102. Moreover, the free end of the release lever forms a free-standing rear portion of the release lever 143. Thus, when a skiboot held in the skibinding 101 is released in its heel region from the heel locking element when the skier falls in the forward direction and is pivoted forwardly upwardly about the pins 125 and thus about the first pivot axis S101, the toe region of the skiboot presses against the rear region of the release lever 143 from a certain pivot angle from obliquely rearwardly above. As a result, the rear region of the release lever 143 is pressed forwardly downwardly. Via the release lever axle 144, this causes the actuating lever 140 to be pressed downward with its free actuating end pointing forward. As a result of the pivoting movement of the actuating lever 140 forced by this, the slider 150 is pressed backwards due to the interaction of the stop 156 with the first counterstop 157. This rearward movement of the slider 150 causes the bearing sections 124 to move apart and the pins 125 to move from their holding position apart. As soon as the pins 125 have moved sufficiently far apart, the skiboot is released from the skibinding 101.

Starting from the downhill configuration, the skibinding 101 can be adjusted to an ascent configuration. In the following, it is illustrated with reference to FIGS. 9*a* to 9*d* that the skibinding 101 can be adjusted from the downhill configuration to an ascent configuration by pulling the free actuating end of the actuating lever 140 upwards until the free actuating end points substantially vertically upwards. During this rotational movement of the actuating lever 140, the two pivot elements 146, which are pivotally mounted on the actuating lever 140 and can be seen in FIG. 6, are moved forward. During this movement, the two pivot elements 146 are no longer merely pivoting relative to the actuating lever 140. Rather, the locking elements 107 are now pulled forward along with the pivot elements 146 by the downwardly pointing nubs of the pivoting elements 146, which engage in the recesses 158 in the front region of the two locking elements 107. Therefore, the locking elements 107 are displaced forward relative to the body of the bearing element 103 to a release position in which they no longer project rearwardly from the body of the bearing element 103 and no longer bear downwardly against the second support element side stop surface 116. This now allows the pivoting movement of the bearing element 103 relative to the support element 102 from the downhill state to the pivoted state and back.

Figure 9A:
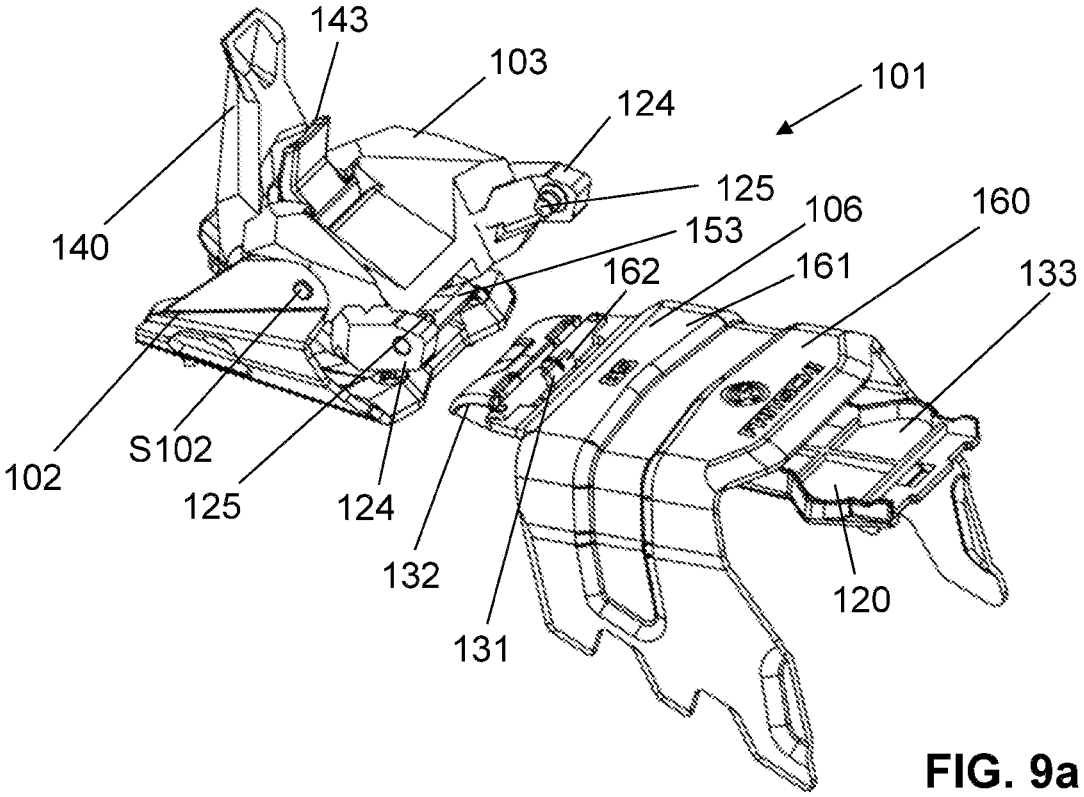
FIG. 9*a* an oblique view of the further ski binding according to the invention in an ascent configuration, wherein a bearing element of the ski binding is in a downhill state and wherein a crampon is attached to a bottom plate of the ski binding.
Figure 9B:
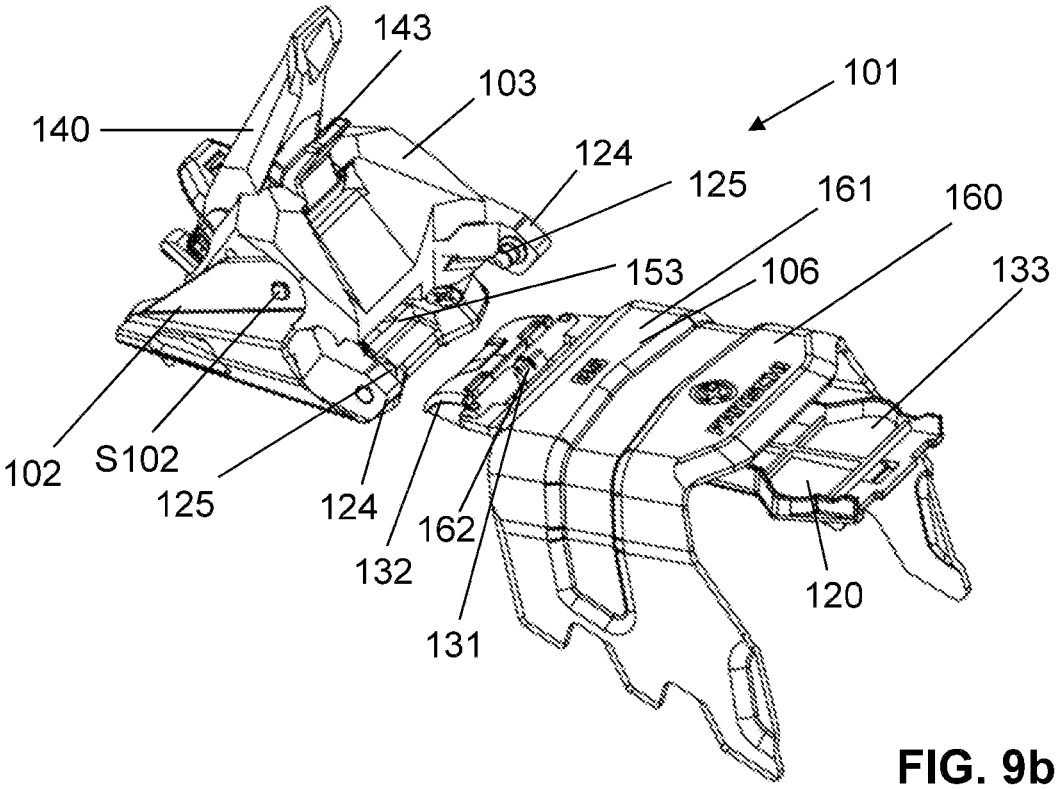
FIG. 9*b* an oblique view of the further skibinding according to the invention in the ascent configuration, wherein the bearing element of the skibinding is in a pivoted state and wherein the crampon is attached to the bottom plate of the skibinding.
Figure 9C:
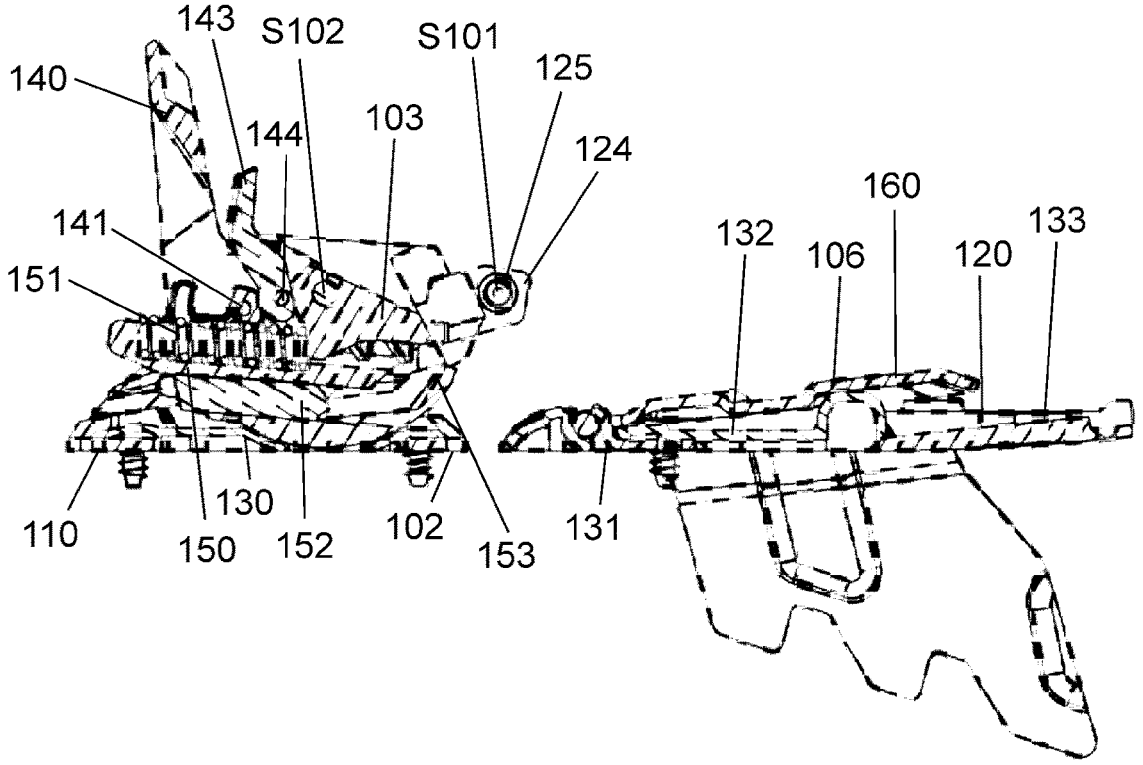
FIG. 9*c* a view of a cross-section extending vertically in the longitudinal direction of the ski through the further skibinding according to the invention in the ascent configuration, wherein the bearing element of the skibinding is in the downhill state and wherein the crampon is attached to the bottom plate of the skibinding.
Figure 9D:
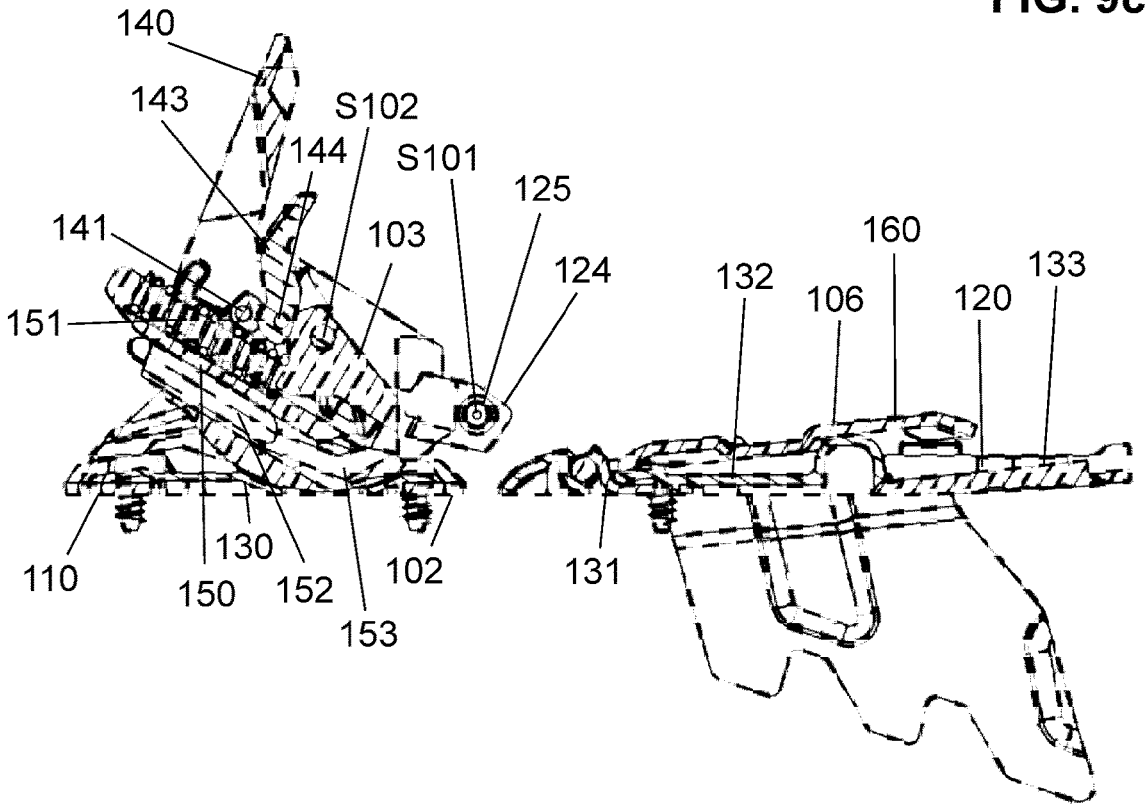
FIG. 9*d* a view of a cross-section extending vertically in the longitudinal direction of the ski through the further skibinding according to the invention in the ascent configuration, wherein the bearing element of the skibinding is in the pivoted state and wherein the crampon is attached to the bottom plate of the skibinding.

FIG. 9*a* therefore shows an oblique view of the skibinding 101 in the ascent configuration, with the bearing element 103 in the downhill state. In contrast, FIG. 9*b* shows an oblique view of the skibinding in the ascent configuration, with the bearing element 103 in the pivoted state. Similarly, FIG. 9*c* shows a vertical cross-sectional view of the skibinding 101 in the ascent configuration with the bearing element 103 in the downhill state, while FIG. 9*d* shows a vertical cross-sectional view of the skibinding 101 in the ascent configuration with the bearing element 103 in the pivoted state.

By pulling the free actuating end of the actuating lever 140 upward until the free actuating end points substantially vertically upward when adjusting from the downhill configuration to an ascent configuration, the connecting slider 152 is also pulled on the cams 154 further forward by the actuating lever 140. As can be seen in FIGS. 9*a* to 9*d*, in the ascent configuration, the connecting slider 152 is correspondingly pulled even further forward in the body of the bearing element 103 than in the downhill configuration. Together with the connecting slider 152, the step spur 153, which is pivotably mounted on the connecting slider 152, is thereby also pulled further forward. As a result, the step spur 153 is almost completely retracted into the body of the bearing element 103, so that the space below the pins 125 is free for the toe area of the skiboot. Accordingly, the skiboot held in the skibinding 101 can be pivoted about the pins 125 and thus about the first pivot axis S101 without being obstructed by the step spur 153.

Furthermore, by pulling the free actuating end of the actuating lever 140 upward when adjusting from the downhill configuration to an ascent configuration, the stop 156 on the actuating lever 140 is pivoted forward. This stop 156 arranged on the actuating lever 140 has already been mentioned above in connection with FIGS. 7*a* and 7*b* and, in the entry configuration of the skibinding 101, is located below the actuating lever axle 141 on the rear side of the actuating lever 140. In the ascent configuration, however, the actuating lever 140 is pivoted so far in comparison with the entry configuration that this stop 156 is located below the actuating lever axle 141 in the longitudinal direction of the ski in front of the actuating lever axle 141. As a result, the stop 156 arranged on the actuating lever 140 abuts against a rearwardly directed second counterstop 159 arranged in the front region of the slider 150. This second counterstop 159 can be seen in the exploded view shown in FIG. 6.

In the ascent configuration, the stop 156 and the second counterstop 159 are aligned and cooperate with each other such that a force acting rearwardly on the slider 150 causes a force on the actuating lever 140 directed in the direction of the actuating lever axle 141. Therefore, no torque is caused to act on the actuating lever 140 when the slider 150 is pushed or pulled rearwardly. As a result, the actuating lever 140 remains in its substantially vertical orientation despite a force acting on the slider 150, and the slider 150 can no longer be moved rearwardly in the body of the bearing element 103, but is locked in position. Because of this blocking of the slider 150 in the ascent configuration of the skibinding 101, the bearing sections 124 are also blocked, meaning that the pins 125 are blocked in their holding position. Accordingly, in the ascent configuration, a skiboot held in the skibinding 101 cannot unintentionally disengage from the skibinding 101. This means that in the ascent configuration, as described earlier, the two bearing sections 124 are locked relative to the body of the bearing element 103 so that the skibinding cannot open and, when walking, the skiboot can be moved from the standing state to the pulling state without disengaging from the skibinding 101.

Figure 10A:
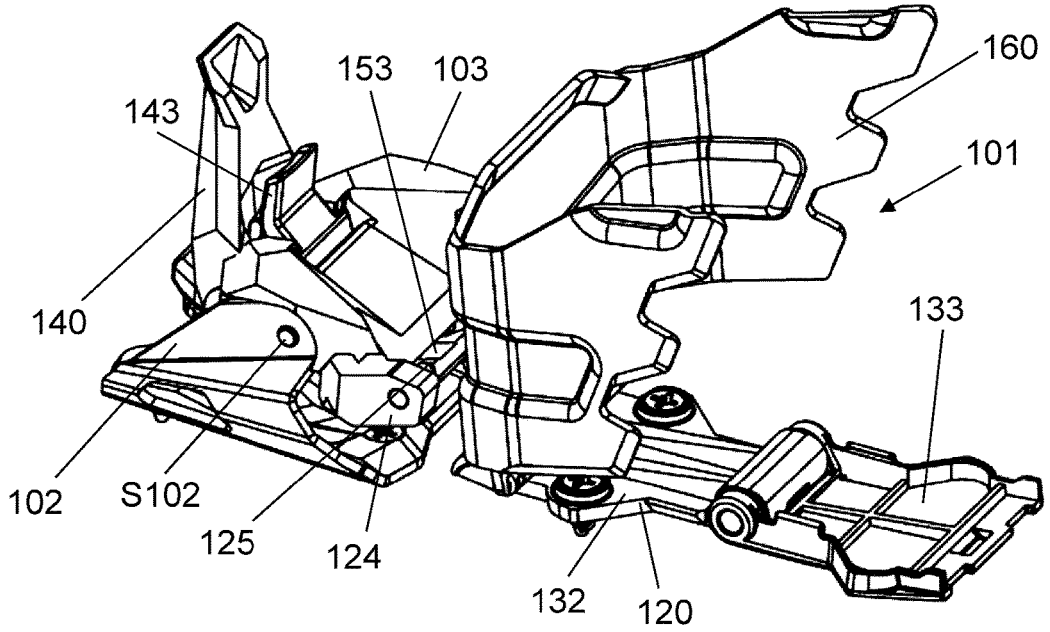
FIG. 10*a* an oblique view of the further skibinding according to the invention in the ascent configuration, wherein the bearing element of the skibinding is in the downhill state and wherein the crampon is attached to the bottom plate of the skibinding and is oriented vertically with its main surface.
Figure 10B:
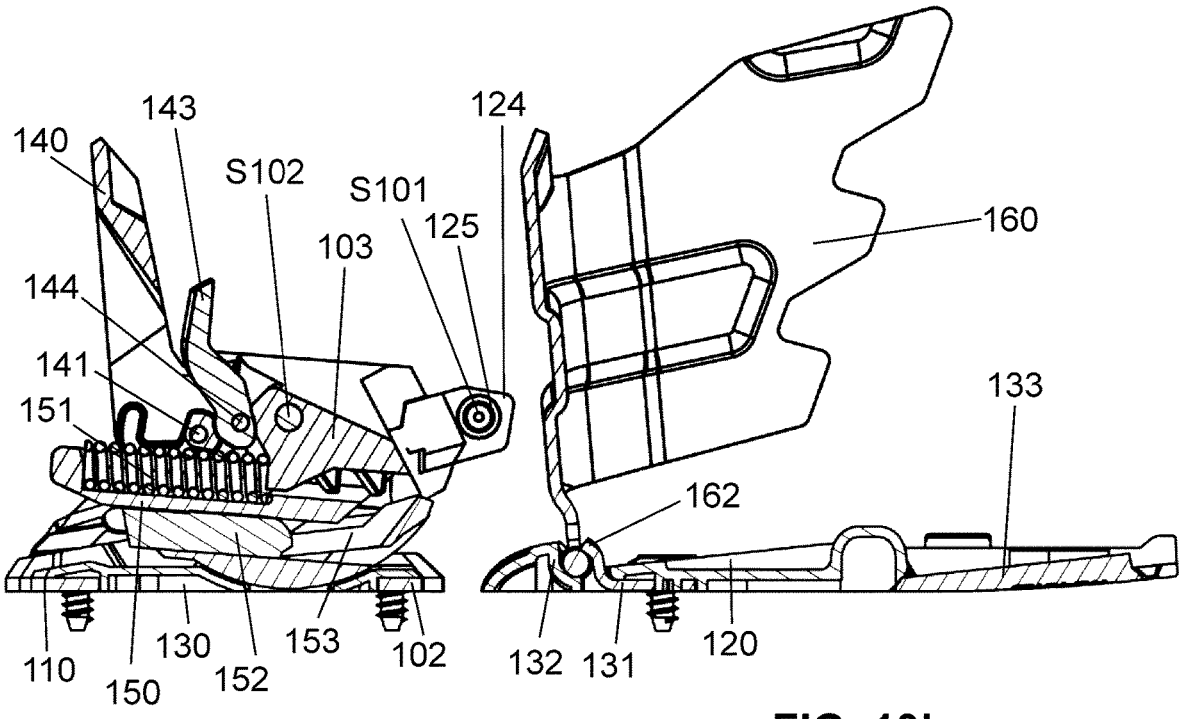
FIG. 10*b* a view of a cross-section extending vertically in the longitudinal direction of the ski through the further skibinding according to the invention in the ascent configuration, wherein the bearing element of the skibinding is in the downhill state and wherein the crampon is attached to the bottom plate of the skibinding and is oriented vertically with its main surface.

As mentioned above, a crampon 160 can be attached to the bottom plate 120. For this purpose, the cover element 133 can be pivoted backwards relative to the base element 132. Since the base sheet 131 forms the crampon holding device 162 in its front region for attaching a crampon 160, the crampon 160 can therefore be attached to the base element 132 when the cover element 133 is pivoted rearward into the uncovered state relative to the base element 132. To do this, the crampon 160 can be inserted into the crampon holding device 162 in the base sheet 131 from the side in the transverse direction of the ski when being in a vertical orientation as shown in FIGS. 10*a* and 10*b*. Subsequently, the crampon 160 can be lowered onto the base element 132 and the cover element 133 with its main surface facing rearwardly toward the ski as shown in FIGS. 9*a* to 9*d*. Because the cover element 133 is pivoted rearward into the uncovered state when the crampon 160 is attached to the bottom plate 120, the base element 132 and the cover element 133 have a lower height than when the cover element 133 is pivoted forward into the cover state onto the base element 132. This lower height in the uncovered state can be filled with the crampon 160 so that the supporting surface 161 of the crampon 160 together with the forward portion of the base element 132 together form the convex supporting surface 106.

In summary, a skibinding, particularly a touring skibinding, is disclosed that provides an improved range of motion during ascent.

| Reference list (not filed) | |
|---|---|
| 1 | skibinding |
| 2 | support element |
| 3 | bearing element |
| 4 | skiboot reception |
| 5 | skiboot |
| 6 | convex supporting surface |
| 7 | locking element |
| 8 | opening |
| 9 | opening |
| 10 | base plate |
| 11 | bearing blocks |
| 12 | bearing openings |
| 13 | bearing bolts |
| 14 | mounting hole |
| 15 | first support element side stop surface |
| 16 | second support element side stop surface |
| 17 | first bearing element side stop surface |
| 18 | second bearing element side stop surface |
| 19 | convex upper side |
| 20 | bottom plate |
| 21 | convex underside |
| 22 | tip |
| 23 | bearing site |
| 24 | bearing sections |
| 25 | pins |
| 26 | joint |
| 27 | mounting surface |
| E | reference plane |
| S1 | first pivot axis |
| S2 | second pivot axis |
| 101 | skibinding |
| 102 | support element |
| 103 | bearing element |
| 104 | boot reception |
| 106 | convex supporting surface |
| 107 | locking element |
| 109 | slits |
| 110 | base plate |
| 111 | bearing blocks |
| 112 | bearing openings |
| 113 | bearing bolts |
| 115 | first support element side stop surface |
| 116 | second support element side stop surface |
| 117 | first bearing element side stop surface |
| 118 | second bearing element side stop surface |
| 119 | convex upper side |
| 120 | bottom plate |
| 124 | bearing sections |
| 125 | pins |
| 127 | mounting surface |
| 130 | insert element |
| 131 | base sheet |
| 132 | base element |
| 133 | cover element |
| 140 | actuating lever |
| 141 | actuating lever axle |
| 142 | actuating lever axle opening |
| 143 | release lever |
| 144 | release lever axle |
| 145 | release lever axle opening |
| 146 | pivot elements |
| 150 | slider |
| 151 | elastic element |
| 152 | connecting slider |
| 153 | step spur |
| 154 | cam |
| 155 | stop |
| 156 | stop |
| 157 | first counterstop |
| 158 | recess |
| 159 | second counterstop |
| 160 | crampon |
| 161 | supporting surface |
| 162 | crampon holding device |
| 163 | bottom element |
| S101 | first pivot axis |
| S102 | second pivot axis |

The invention claimed is:

1. A skibinding, comprising a support element which can be fastened to the ski, a bearing element with a skiboot reception which is designed in such a way that the skiboot can be mounted in the skiboot reception such that the skiboot can pivot about a first pivot axis with respect to the skiboot reception, and a convex supporting surface on which the skiboot can roll, wherein the bearing element is connected to the support element pivotably about a second pivot axis from an initial position to a pivoted position, wherein the skiboot is movable from a standing state, in which the skiboot stands on the convex supporting surface, into a pulling state, in which the skiboot is at least partially lifted from the convex supporting surface, and wherein, starting from the standing state, the skiboot is movable on the convex supporting surface in the direction of a pulling state in such a way that the skiboot rolls on the convex supporting surface, wherein a pivoting movement of the skiboot about the first pivot axis and of the bearing element about the second pivot axis is effected simultaneously with the rolling process.

2. The skibinding according to claim 1, wherein during the movement of the skiboot in the direction of the pulling state, the boot reception is pivoted with the first pivot axis with respect to the second pivot axis downwards towards the support element or in the direction of the ski, respectively.

3. The skibinding according to claim 1, wherein, during the movement of the skiboot into the pulling state, the bearing element, after reaching an intermediate state, is fixedly abutted to the support element in the pivoted state in a first phase of the movement between the intermediate state and the pulling state, and is pivoted back to its initial state in a second phase of said movement.

4. The skibinding according to claim 1, wherein the first pivot axis runs parallel to the second pivot axis, and in that the first pivot axis can be pivoted about the second pivot axis, wherein the first pivot axis can be moved away from the ski by at least 10 mm starting from the pivoted state of the bearing element by a pivoting movement of the bearing element about the second pivot axis and/or in that the maximum pivot angle of the skiboot about the first pivot axis is greater than the maximum pivot angle of the first pivot axis about the second pivot axis.

5. The skibinding according to claim 1, wherein the first pivot axis and the second pivot axis span a reference plane in the standing state, the first pivot axis being moved away from this reference plane starting from the standing state and being moved back towards this reference plane before the pulling state is reached.

6. The skibinding according to claim 1, wherein the first pivot axis provides an articulated joint between the skiboot and the skiboot reception, and/or in that the first pivot axis is located at least in the initial state between the second pivot axis and the skiboot.

7. The skibinding according to claim 1, wherein the touring skibinding further comprises a locking element with which the bearing element can be locked to the support element so that pivoting between the bearing element and the support element is made impossible.

8. The skibinding according to claim 1, wherein the support element has a base plate from which two spaced-apart bearing blocks project, the bearing blocks having the bearing sites for the pivotable mounting of the bearing element relative to the support element, and the bearing element extending between the two bearing blocks.

9. The skibinding according to claim 8, wherein each of the bearing blocks has a bearing opening, wherein a bearing bolt extends through the bearing opening and wherein the bearing element is mounted on said bearing bolt, and/or in that the skiboot reception is located in any state outside the spatial area between the two bearing blocks.

10. The skibinding according to claim 1, wherein the support element has a first support element side stop surface and a second support element side stop surface, and in that the bearing element has a first bearing element side stop surface and a second bearing element side stop surface, wherein in the initial state the first bearing element side stop surface abuts against the first support element side stop surface and wherein in the pivoted state the second bearing element side stop surface abuts against the second support element side stop surface.

11. The skibinding according to claim 1, wherein the convex supporting surface is provided by a convex upper side of a bottom plate and/or wherein the convex supporting surface can be provided by a convex underside of the skiboot.

12. The skibinding according to claim 1, wherein the skibinding has a bottom plate, which bottom plate comprises a crampon holding device for attaching a crampon to the bottom plate and for holding the crampon, the bottom plate comprising a base element attachable to the ski and a cover element attachable to the base element, a) wherein the cover element is movable into a cover state in which a supporting surface of the cover element is oriented such that the skiboot held in the skibinding can be supported downwardly on the supporting surface, b) wherein the cover element is movable away from the cover state, wherein, when the cover element is moved away from its cover state, in particular into the uncovered state, the crampon is attachable to the crampon holding device to be held by the crampon holding device.

13. The skibinding according to claim 1, wherein the bearing element has two bearing sections, which bearing sections extend away from the bearing element, the bearing sections being spaced apart from each other in such a way that a space is created between the bearing sections into which space the skiboot can project and wherein the skiboot reception is provided at the free end of the bearing sections.

14. The skibinding, according to claim 1, which is configured, by means of the skiboot reception, to pivotally connect to a bearing site on a tip of a skiboot.

15. The skibinding, according to claim 14, which is configured to be attached to a ski by means of the support element.

16. The skibinding according to claim 1, wherein the first pivot axis runs parallel to the second pivot axis, and in that the first pivot axis can be pivoted about the second pivot axis, wherein the first pivot axis can be moved away from the ski by at least 15 mm starting from the pivoted state of the bearing element by a pivoting movement of the bearing element about the second pivot axis and/or in that the maximum pivot angle of the skiboot about the first pivot axis is greater than the maximum pivot angle of the first pivot axis about the second pivot axis.

17. The skibinding according to claim 1, wherein the skibinding has a bottom plate, which bottom plate comprises a crampon holding device for attaching a crampon to the bottom plate and for holding the crampon, the bottom plate comprising a base element attachable to the ski and a cover element attachable to the base element, a) wherein the cover element is movable into a cover state in which a supporting surface of the cover element is oriented such that the skiboot held in the skibinding can be supported downwardly on the supporting surface, b) wherein the cover element is movable away from the cover state into an uncovered state, wherein, when the cover element is moved away from its cover state into the uncovered state, the crampon is attachable to the crampon holding device to be held by the crampon holding device.

18. The skibinding according to claim 1, wherein the skibinding is a tourings skibinding.

* * * * *